US010053849B2

(12) United States Patent
Matsuo et al.

(10) Patent No.: US 10,053,849 B2
(45) Date of Patent: Aug. 21, 2018

(54) FLUSH TOILET

(71) Applicant: TOTO LTD., Kitakyushu-shi, Fukuoka (JP)

(72) Inventors: Naoto Matsuo, Kitakyushu (JP); Eiji Shiohara, Kitakyushu (JP); Hiroyuki Hara, Kitakyushu (JP); Yoshikatsu Adachi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/417,445

(22) Filed: Jan. 27, 2017

(65) Prior Publication Data

US 2017/0241120 A1 Aug. 24, 2017

(30) Foreign Application Priority Data

Feb. 19, 2016 (JP) ..... 2016-030052
Nov. 30, 2016 (JP) ..... 2016-232477

(51) Int. Cl.
*E03D 11/08* (2006.01)

(52) U.S. Cl.
CPC ..... *E03D 11/08* (2013.01)

(58) Field of Classification Search
CPC ..... E03D 11/08; E03D 1/00
USPC ..... 4/420
See application file for complete search history.

(56) References Cited

U.S. PATENT DOCUMENTS 9,157,225 B2 * 10/2015 Kashirajima ..... E03D 11/08 4/420
2014/0289947 A1 * 10/2014 Hirakawa ..... E03D 11/08 4/421
2014/0289948 A1 * 10/2014 Kitaura ..... E03D 11/08 4/432

FOREIGN PATENT DOCUMENTS

JP 4062731 B2 3/2008

* cited by examiner

*Primary Examiner* — Tuan N Nguyen
(74) *Attorney, Agent, or Firm* — Studebaker & Brackett PC

(57) ABSTRACT

A flush toilet of the present invention is provided with a toilet main body and a storage tank supplying cleaning water to a supply opening of the toilet main body. The toilet main body includes a bowl, a rim, a rim water passage formed on an entire circumference of the rim, and an aperture formed on the entire circumference of the rim, and a water conduit formed between the supply opening and the rim water passage. The water conduit includes an upstream water conduit extending to the right side from the supply opening, and a downstream water conduit extending to the left side from the upstream water conduit, and the downstream water conduit is formed such that a downstream end of an inner wall surface on the right side is positioned in the left side to a center line of the toilet main body in the left-right direction.

9 Claims, 11 Drawing Sheets

FLUSH TOILET

BACKGROUND OF THE INVENTION

Field of the Invention

The present invention relates to a flush toilet, and particularly, to a flush toilet that cleans a bowl by cleaning water.

Description of the Related Art

There are conventionally known, for example, a conventional flush toilet as shown in Japanese Patent No. 4062731 and a conventional flush toilet 401 having the structure as similar to Japanese Patent No. 4062731 as illustrated in FIG. 11 provided with a so-called open rim structure in which a slit aperture 412 is formed on a bottom surface of a rim water passage 406 in a rim 404 of a toilet main body 402. In such an open rim structure, an amount of cleaning water flowing down to a bowl 408 from the inside of the rim 404 is adjusted by adjusting a width of the slit aperture 412 between the rim 404 and the bowl 408.

As illustrated in FIG. 11, in the flush toilet 401 having the conventional open rim structure in Japanese Patent No. 4062731, a water conduit 410 is connected to the rim water passage 406 in the center vicinity of the toilet main body 402 such that the supplied cleaning water can be divided into a clockwise direction and a counterclockwise direction in the rim water passage 406 to flow therein and clean the bowl 408.

However, in this conventional flush toilet 401, when a cleaning water amount for the cleaning is reduced because of a recent demand for economization of water, the momentum of the cleaning water to be supplied to the rim water passage 406 is made weak because of a reduction in cleaning water amount, and a relatively large deal of the cleaning water, as indicated at an arrow B1, flows down from the slit aperture 412 to the bowl 408 in a merging portion in the vicinity of an exit in the water conduit 410 in the central, rear side of the toilet main body 402. As a result, as indicated at an arrow B2, the cleaning water that would swirl along the rim water passage 406 becomes insufficient, creating a problem of a defect in the cleaning of the bowl 408.

Further, even if the cleaning water flowing down from the slit aperture 412 in the vicinity of the exit of the water conduit 410 is designed to be reduced by simply forming the width of the slit aperture 412 to be small, the momentum of the cleaning water that would swirl in the rim water passage 406 cannot be still strengthened, creating a problem that the cleaning water cannot go around in the rim water passage 406.

In addition thereto, there is a problem that it is difficult to form the width of the slit aperture 412 to be small in view of the manufacture, and therefore the width of the slit aperture 412 cannot be made small.

Further, as illustrated in FIG. 11, the structure in which the toilet main body 402 turns from the center immediately before the merging portion between the water conduit 410 and the rim water passage 406 is the structure that the supplied cleaning water is originally designed to be divided into a clockwise direction and a counterclockwise direction from the center in the rim water passage 406 to flow over the entire rim water passage 406. Therefore in a case where the cleaning water amount is reduced, the flow having the stronger momentum cannot be formed, creating a problem that the cleaning water cannot go around in the rim water passage from one side of the left and right sides.

Therefore the present invention is made for solving the foregoing problems in the conventional technology, and an object of the present invention is to provide a flush toilet in which cleaning water flowing out to a rim water passage from a downstream water conduit in a water conduit of a toilet main body is suppressed from flowing down in a region in the vicinity of a center line of a bowl in a left-right direction, making it possible to sufficiently clean the bowl by an excellent swirl flow of the cleaning water swirling in the rim water passage.

SUMMARY OF THE INVENTION

For achieving the above object, the present invention provides a flush toilet that cleans a bowl by cleaning water, comprising: a toilet main body; and a water supply device that supplies the cleaning water to a supply opening of the toilet main body; the toilet main body including: a bowl having a waste receiving surface having a bowl shape, a rim provided on an upper side of the waste receiving surface, a rim water passage formed on an entire circumference of the rim to introduce the cleaning water, and an aperture formed on the entire circumference of the rim to supply the cleaning water on the waste receiving surface from the rim water passage; a discharge passage an inlet of which is connected to a lower side of the bowl to discharge wastes; and a water conduit formed between the supply opening and the rim water passage to introduce the cleaning water to the rim water passage; wherein the water conduit includes an upstream water conduit extending to one side of the toilet main body in the left-right direction from the supply opening, and a downstream water conduit extending to the other side in the left-right direction from the upstream water conduit, and the downstream water conduit is formed such that a downstream end of an inner wall surface on one side in the left-right direction is positioned in the other side to a center line of the toilet main body in the left-right direction.

In the present invention as thus configured, the cleaning water turns from the upstream water conduit extending to the one side of the toilet main body in the left-right direction, flows into the downstream water conduit, and is introduced to the other side in the left-right direction along the downstream water conduit. The cleaning water flowing along the inner wall surface on the one side of the downstream water conduit in the left-right direction in the cleaning water introduced to the other side in the left-right direction can flow along the inner wall surface to a downstream end portion positioned in the other side to the center line of the toilet main body. Accordingly the cleaning water flowing out from the vicinity of the downstream end portion of the inner wall surface can be suppressed from flowing down in a region of the center line vicinity and form a main flow of the cleaning flow toward the rim water passage from the downstream water conduit. Therefore in the so-called open rim type flush toilet having the aperture formed on the entire circumference of the rim, it is possible to form the excellent swirl flow of the cleaning water to swirl in the rim water passage, and even in a case where the cleaning water amount to be used for toilet cleaning is set to be small, the bowl can be sufficiently cleaned by the swirl flow.

According to the present invention, preferably a width of the downstream water conduit is smaller than a width of the upstream water conduit.

According to the present invention as thus configured, a flow velocity of the cleaning water flowing into the downstream water conduit from the upstream water conduit increases in the downstream water conduit, and the cleaning water flowing out from the vicinity of the downstream end portion of the inner wall surface is suppressed from flowing to spread out to the region in the center line vicinity. Further, the main flow of the cleaning water toward the rim water passage from the downstream water conduit can be formed, and more excellently it is possible to form the swirl flow of the cleaning water to swirl in the rim water passage.

According to the present invention, preferably a width of the downstream water conduit is made smaller toward an exit of the downstream water conduit from an inlet of the downstream water conduit.

According to the present invention as thus configured, a flow velocity of the cleaning water flowing into the downstream water conduit increases toward the exit of the downstream water conduit from the inlet of the downstream water conduit. Therefore the cleaning water flowing out from the vicinity of the downstream end portion of the inner wall surface is further suppressed from flowing to spread out to the region in the center line vicinity. Further, the main flow of the cleaning water toward the rim water passage from the downstream water conduit can be formed, and more excellently it is possible to form the swirl flow of the cleaning water to swirl in the rim water passage.

According to the present invention, preferably a width of the downstream water conduit is made larger toward an exit of the downstream water conduit from an inlet of the downstream water conduit.

According to the present invention as thus configured, since the width of the downstream water conduit is made larger toward the exit from the inlet, in a case where the water momentum of the cleaning water to be supplied to the supply opening of the toilet main body from the water supply device is made weaker in the latter half of a toilet cleaning operation, the cleaning water flowing out from the exit of the downstream water conduit can form the flow spreading out in a fan shape corresponding to the widening of the width of the downstream water conduit to clean a wide range of the bowl more uniformly.

According to the present invention, preferably a center line of the upstream water conduit extends to be biased to one side in the left-right direction from a center of the supply opening.

According to the present invention as thus configured, since the center line of the upstream water conduit extending to the one side of the toilet main body in the left-right direction from the supply opening extends to be biased to an extension direction of the upstream water conduit in the left-right direction from the center of the supply opening, the cleaning water flowing out from the supply opening can relatively smoothly flow out to the biased upstream water conduit from the extension direction side of the upstream water conduit in the left-right direction from the center of the supply opening. Therefore as compared to a case where the center axis of the upstream water conduit is not biased from the center of the supply opening, the cleaning water can relatively smoothly flow into the upstream water conduit from the supply opening in a side of the biased upstream water conduit.

According to the present invention, preferably the water conduit further includes a bending portion formed between an exit of the upstream water conduit and an inlet of the downstream water conduit, wherein the bending portion is formed such that a curvature radius of an outer circumference wall of a flow passage in the bending portion is smaller than a curvature radius of an inner circumference wall of the flow passage.

In the present invention as thus configured, since the curvature radius of the outer circumference wall of the flow passage in the bending portion is smaller than the curvature radius of the inner circumference wall of the flow passage, the flow along the outer circumference wall of the flow passage in the bending portion can be guided toward the flow along the inner circumference wall of the flow passage in the bending portion, and the momentum of the cleaning water flowing into the rim water passage along the wall surface extending from the inner circumference wall side to the downstream water conduit is strengthened, making it easier to form the flow to swirl in the rim water passage.

According to the present invention, preferably the water supply device includes a storage tank that stores cleaning water, wherein a bottom portion of the storage tank is provided with a discharge opening that supplies the cleaning water to the supply opening of the toilet main body, and the discharge opening of the storage tank is provided with a guiding device that guides the cleaning water to be supplied to the supply opening of the toilet main body to an extension direction of the upstream water conduit.

In the present invention as thus configured, since the discharge opening of the storage tank has the guiding device that guides the cleaning water to be supplied to the supply opening of the toilet main body to the extension direction of the upstream water conduit, the cleaning water flows along the guiding device. Therefore the flow of the cleaning water flowing into the supply opening from the discharge opening can be guided to the upstream water conduit direction. Therefore it can be made easier for the cleaning water supplied to the supply opening to go to the extension direction of the upstream water conduit, more excellently forming the swirl flow of the cleaning water that will swirl in the rim water passage.

According to the present invention, preferably the guiding device is a cylindrical guiding member for connection between the discharge opening and the supply opening, wherein the guiding member is provided with a narrowed portion projecting inside from a part of or an entire circumference of an inner wall of the guiding member such that the cleaning water supplied to the supply opening flows to the extension direction of the upstream water conduit.

In the present invention as thus configured, the guiding device is the cylindrical guiding member for connection between the discharge opening and the supply opening, and since the guiding member is provided with the narrowed portion projecting inside from a part of or an entire circumference of the inner wall of the guiding member such that the cleaning water supplied to the supply opening flows to the extension direction of the upstream water conduit, when the cleaning water entering into the guiding member from the discharge opening flows to the supply opening of the toilet main body, the cleaning water is guided by the guiding member, and a large part of the cleaning water goes to the extension direction of the upstream water conduit. Therefore it is possible to create the flow of the cleaning water going to the extension direction of the upstream water conduit, more excellently forming the swirl flow of the cleaning water that will swirl in the rim water passage.

Further, the present invention provides a flush toilet that cleans a bowl by cleaning water, comprising: a toilet main body; and a water supply device that supplies the cleaning water to a supply opening of a toilet main body; the toilet main body including a bowl having a waste receiving surface having a bowl shape, a rim provided on an upper edge portion of the bowl, a rim water passage formed on an inner circumference of the rim to introduce the cleaning water, and a spout portion opening on the rim water passage and spouting the cleaning water to the rim water passage; a discharge passage connected to a lower side of the bowl to discharge wastes; and a water conduit formed between the supply opening and the spout portion to introduce the cleaning water to the spout portion, wherein the water conduit includes an upstream water conduit extending to one side of the toilet main body in the left-right direction from the supply opening, and a downstream water conduit extending to the other side in the left-right direction from the upstream water conduit, and the downstream water conduit is formed such that a downstream end of an inner wall surface on one side in the left-right direction is positioned in the other side to a center line of the toilet main body in the left-right direction.

In the present invention as thus configured, the cleaning water turns from the upstream water conduit extending to the one side of the toilet main body in the left-right direction, flows to the downstream water conduit, and is introduced to the other side in the left-right direction along the downstream water conduit. The cleaning water flowing along the inner wall surface on the one side of the downstream water conduit in the left-right direction in the cleaning water introduced to the other side in the left-right direction can flow along the inner wall surface to the downstream end portion positioned in the other side to the center line of the toilet main body. Accordingly the cleaning water flowing out from the vicinity of the downstream end portion of the inner wall surface can form a main flow of the cleaning water toward the spout portion from the downstream water conduit. Therefore in the so-called non-brim type flush toilet, the cleaning water spouted from the spout portion can form the excellent swirl flow of the cleaning water to swirl on the waste receiving surface, and even in a case where the cleaning water amount to be used for toilet cleaning is set to be small, the bowl can be sufficiently cleaned by the swirl flow.

According to the flush toilet of the present invention, the cleaning water flowing out to the rim water passage from the downstream water conduit in the water conduit of the toilet main body can be suppressed from flowing down in the region in the vicinity of the center line of the bowl in the left-right direction, making it possible to sufficiently clean the bowl by an excellent swirl flow of the cleaning water swirling in the rim water passage.

DETAILED DESCRIPTION OF THE PREFERRED EMBODIMENTS

Hereinafter, an explanation will be made of a flush toilet according to embodiments of the present invention with reference to the accompanying drawings.

First, an explanation will be made of a flush toilet according to a first embodiment of the present invention with reference to FIG. 1 to FIG. 3.

Figure 1:
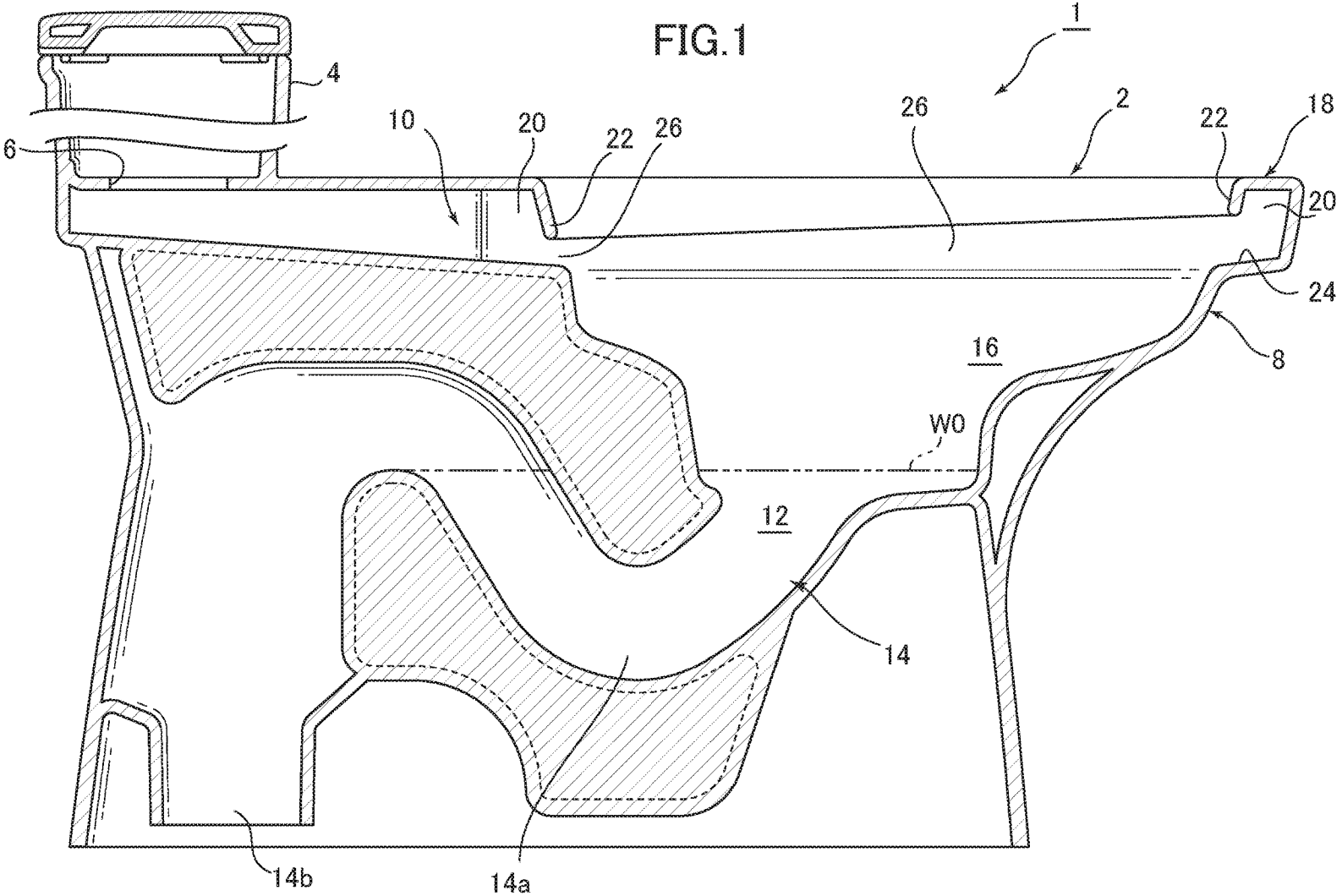
FIG. 1 is a side cross section illustrating a flush toilet according to a first embodiment of the present invention.
Figure 2:
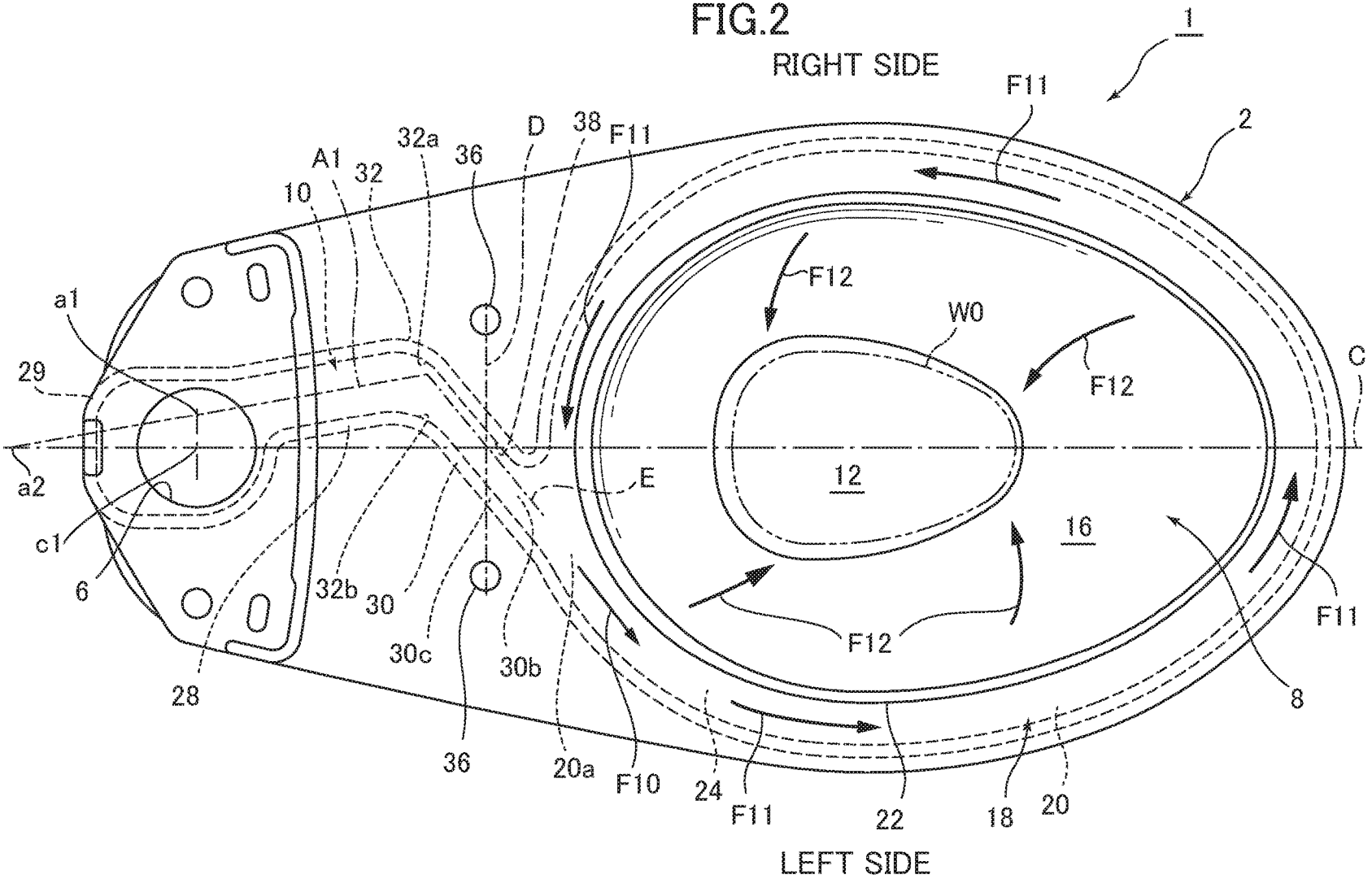
FIG. 2 is a plan view of a toilet main body in the flush toilet according to the first embodiment of the present invention.
Figure 3:
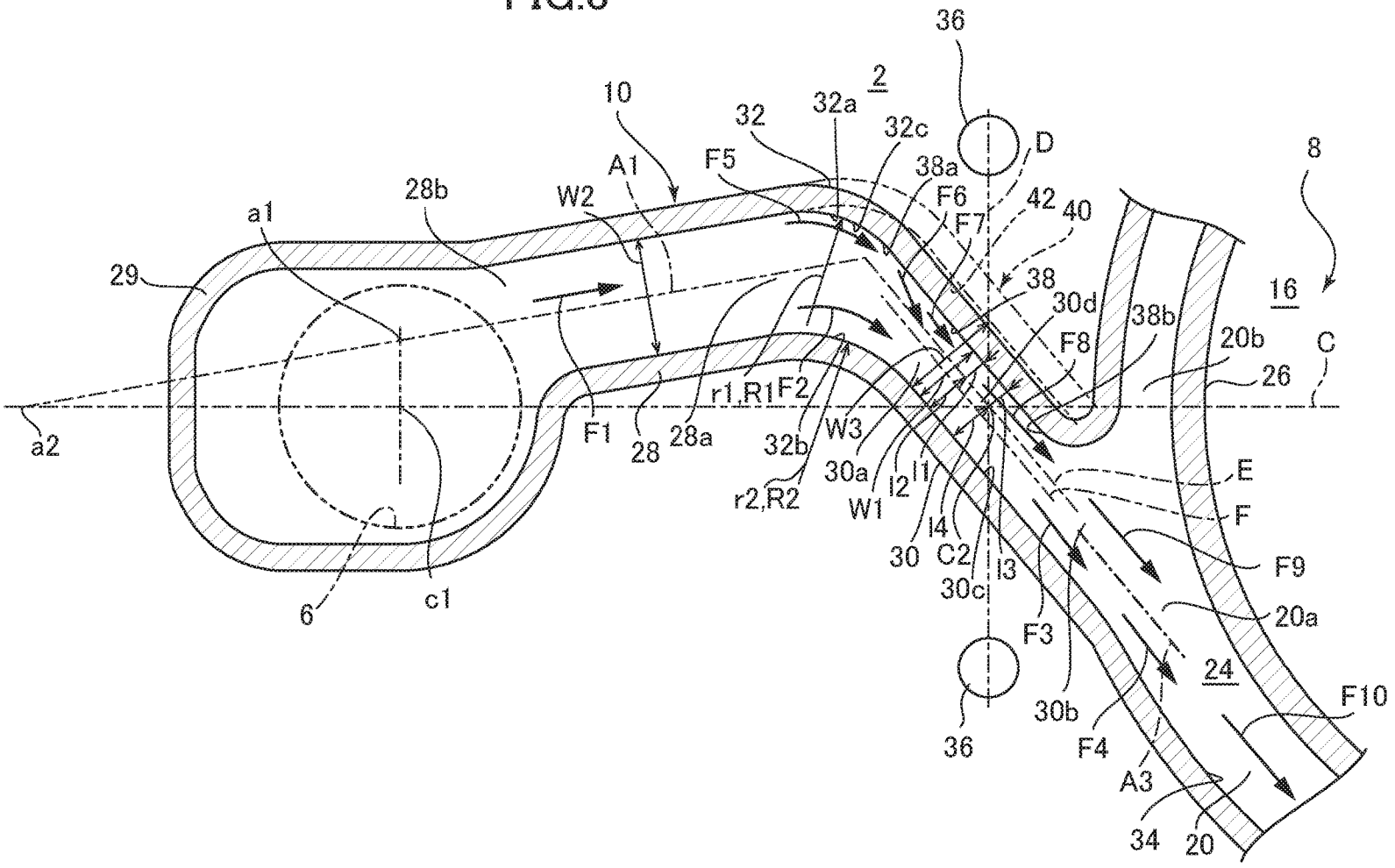
FIG. 3 is a schematic partial enlarged view illustrating a flow passage in a rear upper portion of the toilet main body in the flush toilet according to the first embodiment of the present invention by a horizontal cross-section plane.

As illustrated in FIG. 1 to FIG. 3, a flush toilet 1 according to the first embodiment of the present invention has a toilet main body 2 formed of a pottery. A storage tank 4 as a water supply device is mounted on an upper side of the toilet main body 2 in the backside.

Here, a cleaning water amount to be supplied from the storage tank 4 is in a range of 3 L to 6.5 L, preferably in a range of 3.8 L to 6.5 L, more preferably in a range of 4.8 L to 6 L.

The water supply device is not only the storage tank but also may be a flush valve or the like that can supply a prescribed cleaning water amount.

A bowl 8 is formed on the front upper portion of the toilet main body 2, and a supply opening 6 to which the cleaning water is supplied from the storage tank 4 is formed on the rear upper portion of the toilet main body 2, and further, a water conduit 10 introducing the cleaning water to the bowl 8 from the supply opening 6 is formed thereupon. The supply opening 6 is arranged substantially in the center of the toilet main body 2 as viewed from the front side of the toilet main body 2.

Further, a pooled water portion 12 is formed in the lower side of the bowl 8, and pooled water having a pooled water plane in an initial water level indicated at W0 is stored in the pooled water portion 12. An inlet 14*a* of a discharge trap conduit 14 (discharge passage) is connected to the lower end of the pooled water portion 12, and the discharge trap conduit 14 extends backward from the inlet 14*a* and a rear end 14*b* thereof is connected to a discharge conduit (unillustrated) installed on a floor surface.

The bowl 8 includes the waste receiving surface 16 formed in a bowl shape, and a rim 18 that is formed on an upper side thereof to spout cleaning water on the waste receiving surface 16. The rim 18 is provided with a rim drooping wall 22 extending to droop to the vicinity of the waste receiving surface 16 downward from the upper surface, and a rim water passage 20 is formed in the inside (outside as viewed from the center of the toilet main body) of the rim 18 by the rim drooping wall 22.

The rim 18 is provided with a slit aperture 26 that is formed therein and by which the inside and lower side of the rim water passage 20 formed along the circumferential direction of the rim 18 is opened over the entire circumference, configuring a so-called open rim. The slit aperture 26 forms a spout portion that spouts the cleaning water on the waste receiving surface 16.

The bowl 8 is provided with a rim water passage bottom surface 24 in a shelf shape formed over substantially the entire circumference of the bowl 8 between the waste receiving surface 16 and the rim 18. The rim water passage bottom surface 24 forms a flat surface formed annularly on the upper portion of the bowl 8, and the flat surface is formed substantially horizontally in the inner direction from the outer direction of the bowl 8.

With the rim water passage bottom surface 24, the cleaning water supplied from the water conduit 10 flows on the rim water passage bottom surface 24 in the rim water passage 20 and can form the flow going around in a counterclockwise direction on the upper portion of the bowl 8.

Next, the details of the water conduit 10 will be described. As illustrated in FIG. 1 and FIG. 2, the supply opening 6 to which the aforementioned storage tank 4 is connected is formed on the rear end of the water conduit 10 in the toilet main body 2, and the cleaning water supplied from the storage tank 4 flows into the water conduit 10 of the toilet main body 2 from the supply opening 6 and flows out to the rim water passage 20 from the water conduit 10.

As illustrated in FIG. 2 and FIG. 3, the water conduit 10 includes an upstream water conduit 28 extending to the right side (one side) of the toilet main body 2 in the left-right direction from the supply opening 6, and a downstream water conduit 30 extending to the left side (the other side) from the upstream water conduit 28 in the left-right direction. The water conduit 10 forms a flow passage bilaterally non-symmetric about a center line C of the toilet main body 2 in the left-right direction. The water conduit 10 forms a flow passage in a V shape by the upstream water conduit 28 and the downstream water conduit 30. The upstream water conduit 28 and the downstream water conduit 30 are connected by a bending portion 32, and the bending portion 32 is positioned in the right region to the center line C of the toilet main body 2.

The upstream water conduit 28 extends linearly toward the oblique right direction from an inlet 28*b* lying right downstream of the supply opening 6 positioned on the center line C of the toilet main body 2 in the left-right direction and extends to an exit 28*a* arranged in the right side to the center line C. The upstream water conduit 28 is arranged such that the front side of the center line A1 is inclined right outward to the center line C.

As illustrated in FIG. 2 and FIG. 3, the supply opening 6 is arranged such that a center point c1 is positioned on the center line C of the toilet main body 2 in the left-right direction. The upstream water conduit 28 is formed such that the center line A1 is biased in the right direction to the center line C of the toilet main body 2. The center line A1 of the upstream water conduit 28 extends to be biased passing a position a1 on the right side of a center point c1 of the supply opening 6 and the center line C of the toilet main body 2.

The center line A1 of the upstream water conduit 28 extends to be biased to the right side to the center line C from the inlet 28*b* to the exit 28*a*. When the center line A1 extends backward, the center line A1 intersects with the center line C in a position a2 in back of the center point c1 of the supply opening 6.

The inlet 28*b* of the upstream water conduit 28 is connected in a position shifted in the right side to the center line C of a wall surface 29 of the outer circumference in the supply opening 6.

The bending portion 32 is formed as a bent flow passage for connection between the exit 28*a* of the upstream water conduit 28 and an inlet 30*a* of the downstream water conduit 30. The bending portion 32 includes an outer circumference wall 32*a* formed on an outer side in the flow passage of the bending portion 32 (outer side of the toilet main body 2) and an inner circumference wall 32*b* formed on an inner side in the flow passage of the bending portion 32.

Here, a curvature radius r1 of the outer circumference wall 32*a* in the bending portion 32 is smaller than a curvature radius r2 of the inner circumference wall 32*b*.

The bending portion 32 is formed such that a ratio in magnitude between the curvature radius r1 of the outer circumference wall 32*a* and the curvature radius r2 of the inner circumference wall 32*b* is set in a range of a ratio of 1:2 to a ratio of 4:5. As an example, a ratio in magnitude between the curvature radius r1 of the outer circumference wall 32*a* and the curvature radius r2 of the inner circumference wall 32*b* is set to a ratio of 3:4.

The downstream water conduit 30 forms a path that extends to the left side from the inlet 30*a* and leads to the exit 30*b*, which is connected to a merging portion 20*a* of the rim water passage 20. The merging portion 20*a* is arranged in a left rear portion of the rim water passage 20. In the merging portion 20*a*, the flow of the cleaning water flowing out from the exit 30*b* of the downstream water conduit 30 and the flow of the cleaning water returning back after going around in the rim water passage 20 merge.

The downstream water conduit 30 forms a linear flow passage obliquely crossing the center line C of the toilet main body 2 to the left from the right from the inlet 30*a* to the exit 30*b*.

The downstream water conduit 30 has the inlet 30*a* arranged in the right region to the center line C, an intermediate portion 30*d* arranged in the vicinity of the center line C and the exit 30*b* arranged in the left region to the center line C. As a result, the downstream water conduit 30 forms a relatively long flow passage that goes over the center line C from the right side of the center line C and extends to a region of the left rear portion of the bowl 8. Since the downstream water conduit inlet 30*a* is arranged in the right side to the center line C, a length from the inlet 30*a* to the exit 30*b* positioned in the left rear region of the bowl 8 is set to a relatively long length. Since the downstream water conduit 30 has the flow passage having the relatively long length, the cleaning water can be appropriately adjusted in flow in the downstream water conduit 30, is enhanced the directivity of the cleaning water, and is spouted by the flow adjusted in the direction of going around on the rim water passage 20 from the exit 30*b* of the downstream water conduit 30 and by the flow in a relatively strong water momentum state.

In a region in which the downstream water conduit 30 and the rim water passage 20 are connected, an outer wall surface 30*c* of the downstream water conduit 30 and a rim water passage outer wall surface 34 of the rim 18 are successively formed in a substantially flat shape. That is, the outer wall surface 30*c* and the rim water passage outer wall surface 34 are formed to be flush in the connection portion vicinity, and an extension direction of the outer wall surface 30*c* substantially corresponds to a tangential direction of the rim water passage outer wall surface 34. Accordingly the cleaning water can smoothly flow along the flat surface linearly extending from the outer wall surface 30*c* of the downstream water conduit 30 to the rim water passage outer wall surface 34 of the rim 18, and suppress a pressure loss of the flow flowing along the outer wall surface 30*c*.

The inner wall surface 38 of the downstream water conduit 30 in the right side extends to the left side of the center line C from the right side of the center line C of the toilet main body 2.

The inner wall surface 38 forms the inlet 30*a* of the downstream water conduit 30, forms an upstream end portion 38*a* connected to a downstream end portion 32*c* of the outer circumference wall 32*a*, the exit 30*b* of the downstream water conduit 30, and forms a downstream end portion 38*b* positioned in the left side to the center line C. Accordingly the inner wall surface 38 extends to go over the center line C from the right side to the left side of the center line C.

The downstream end portion 38*b* of the inner wall surface 38 in the downstream water conduit 30 forms a convex portion projecting to the left side to the center line C. The downstream end portion 38*b* of the inner wall surface 38 is connected to the rim water passage outer wall surface 34 extending from the rear side of the waste receiving surface 16 in the left region to the center line C.

Since the downstream end portion 38*b* forms the convex portion projecting to the left side to the center line C, the downstream end portion 38*b* sections the flow passage of the downstream water conduit 30 from the center rear region 20*b* of the rim water passage 20.

Here, the inner wall surface 38 in the downstream water conduit 30 is formed closer to a virtual center line E (shown in a virtual line in FIG. 3), which will be described later, of the downstream water conduit 30. At this time, the outer wall surface 30*c* in the downstream water conduit 30 is not closer to the virtual center line E.

The virtual center line E, as illustrated in FIG. 3, is a center line of the flow passage in a virtual downstream conduit 40 and extends in parallel to an extension direction of the virtual downstream conduit 40, and is a virtual center line between a virtual inner wall surface 42 and the outer wall surface 30*c*.

An explanation will be made of a state in which the inner wall surface 38 in the downstream water conduit 30 is "closer" to the virtual center line E and the outer wall surface 30*c* and a shape of the inner wall surface 38.

The virtual downstream conduit 40 having substantially the same width as the upstream water conduit 28 is assumed to the downstream water conduit 30. The virtual downstream conduit 40 is provided with the virtual inner wall surface 42 in the right side of the virtual downstream conduit 40 in the left-right direction.

This virtual downstream conduit 40 is connected to the downstream side of the upstream water conduit 28 and the bending portion 32, and is arranged such that the virtual center line E of the virtual downstream conduit 40 passes an intersection point C2 between the center line C and an attaching position line D connecting attaching portions 36 positioned in both sides of the center line C in the left-right direction. In such a virtual downstream conduit 40, the virtual center line E is arranged in the center of the virtual inner wall surface 42 and the outer wall surface 30*c*, and the virtual inner wall surface 42 and the outer wall surface 30*c* are arranged in symmetric about the virtual center line E.

By moving the virtual inner wall surface 42 closer to the virtual center line E of the virtual downstream conduit 40, for example, by parallel movement, the inner wall surface 38 of the downstream water conduit 30 is formed. Therefore a width W1 of the downstream water conduit 30 is smaller than a width W2 of the upstream water conduit 28. The width W1 of the downstream water conduit 30 is smaller than, and approximately three-fourths of, a width W3 of the virtual downstream conduit 40. Therefore a distance 11 from the virtual center line E connecting a point of the upstream water conduit 28 on the center line A1 and the intersection point C2 to the inner wall surface 38 is shorter than a distance 12 from the virtual center line E to the outer wall surface 30*c*. A distance 13 from the intersection point C2 to the inner wall surface 38 is shorter than a distance 14 from the intersection point C2 to the outer wall surface 30*c*.

The downstream water conduit 30 is formed such that the W1 between the inner wall surface 38 and the outer wall surface 30*c* is substantially constant. Therefore the width of the downstream water conduit 30 is substantially constant from the inlet 30*a*, through the intermediate portion 30*d* and to the exit 30*b* of the downstream water conduit 30.

In this way, the inner wall surface 38 and the outer wall surface 30*c* are formed to be non-symmetric about the virtual center line E. As described above, since the inner wall surface 38 is closer to the virtual center line E, an actual center line F as an actual center line of the downstream water conduit 30 is closer to the outer wall surface 30*c*-side than the virtual center line E. Therefore the actual center line F intersects with the attaching position line D in a region in the left side to the intersection point C2.

When the inner wall surface 38 of the downstream water conduit 30 is closer to the outer wall surface 30*c*, the downstream end portion 38*b* of the inner wall surface 38 is positioned in a region in the left side to the center line C.

The actual center line F of the downstream water conduit 30 is arranged such that the front side is inclined in a left outer direction to the center line C. An intersection point between the center line A1 of the upstream water conduit 28 and the actual center line F of the downstream water conduit 30 is positioned in the right side to the center line C, and the downstream water conduit exit 30*b* is positioned in the left side to the center line C. The downstream water conduit 30 and the upstream water conduit 28 are arranged such that an angle between the center line A1 and the center line C is smaller than an angle between the virtual center line E (or the actual center line F) and the center line C. For example, the virtual center line E has an angle in a range of 30° to 70°, preferably 40° to 60° to the center line C.

The downstream water conduit 30 forms such a flow passage that a part thereof is in parallel to at least a part of a flow passage in the merging portion 20*a* of the rim water passage 20.

The inner wall surface 38 of the downstream water conduit 30 is formed with such an inclination that a straight line extending along the inner wall surface 38 extends on the rim water passage 20.

As a result, in the vicinity of the exit 30*b* of the downstream water conduit 30, a direction of the actual center line F of the downstream water conduit 30 substantially corresponds to a direction of a flow line A3 of the cleaning water going around on the rim water passage 20 in the merging portion 20*a*. Therefore the cleaning water flowing out from the exit 30*b* of the downstream water conduit 30 flows toward substantially the same swirling direction (counterclockwise direction) on the rim water passage 20, making it possible to form a main flow going around on the rim water passage 20 in a state of holding the water momentum (state of substantially maintaining the flow amount and flow velocity). Accordingly it is possible to suppress the cleaning water merging in the merging portion 20*a* of the rim water passage 20 from the downstream water conduit 30 from passing and flowing on the rim water passage 20 toward the reverse swirling direction to the direction of the main flow on the rim water passage 20 and further, from flowing to spread out toward the center rear region 20*b*-side to flow down on the waste receiving surface 16 from the slit aperture 26.

The toilet main body 2 has the attaching portions 36 for attaching a toilet seat on the toilet main body 2. The attaching portions 36 are provided in positions of the vicinity in both sides in the left and right of the toilet main body 2 in back of the rim water passage 20. Since the attaching portion 36 forms the attachment structure toward the inside of the toilet main body 2, the downstream water conduit 30 cannot be formed in a position of forming the attaching portion 36. The downstream water conduit 30 is formed between the attaching portions 36 in both sides in the left and right, therefore making it possible to provide the downstream water conduit 30 to avoid the attaching portions 36 and further, the flow passage in a relatively long length is formed. Here, a virtual straight line for connection between the attaching portions 36 of both sides in the left and right is defined as the attaching position line D. The attaching position line D extends in the left-right direction of the toilet main body 2 to be perpendicular to the center line C. The downstream water conduit 30 is arranged to obliquely intersect with the attaching position line D in a range of an angle larger than 0° and smaller than 90°.

Next, an explanation will be made of a function (operation) of the flush toilet according to the first embodiment of the present invention as described above.

First, when an operating lever (unillustrated) of the storage tank 4 is operated, a discharge valve (unillustrated) in the storage tank 4 opens, and the cleaning water (for example, 6.0 L) is supplied to the water conduit 10 through the supply opening 6 of the toilet main body 2 from the storage tank 4.

The cleaning water supplied to the supply opening 6 of the toilet main body 2 from the storage tank 4, as indicated at an arrow F1, flows into the upstream water conduit 28 from the right side to which the upstream water conduit 28 is biased. The cleaning water flowing into the upstream water conduit 28 flows to be gradually biased to the right side. That is, the cleaning water flows toward the right side to be away from the center axis line C. When the cleaning water reaches the exit 28*a* of the upstream water conduit 28, the cleaning water turns in the bending portion 32. That is, the cleaning water turns from the flow of the right direction to the flow of the left direction of the toilet main body 2.

On the inner circumference side of the bending portion 32, the cleaning water, as indicated at an arrow F2, flows along the inner circumference wall 32*b* having a relatively large curvature radius r2. The cleaning water further flows along the outer wall surface 30*c*, merges with a water flow F6 of the cleaning water to be described later, and as indicated at arrows F3 and F4, flows toward the rim water passage 20 along the outer wall surface 30*c* of the downstream water conduit 30 from the inner circumference wall 32*b*-side.

On the outer circumference side of the bending portion 32, the cleaning water, as indicated at an arrow F5, turns along the outer circumference wall 32*a* having a relatively small curvature radius r1 and flows to the inner direction to bounce back. At this time, the cleaning water turns relatively largely along an arc having a small curvature radius of the outer circumference wall 32*a* and, as indicated at F6, flows in a direction of the outer wall surface 30*c* of the downstream water conduit 30. Since the curvature radius r1 of the outer circumference wall 32*a* is relatively small, a main flow of the cleaning water flowing along the outer circumference wall 32*a* can be separated from the inner wall surface 38 to be directed toward a direction of the outer wall surface 30*c*. Further, a percentage of a flow F7 flowing along the inner wall surface 38 lying downstream of the outer circumference wall 32*a* is relatively suppressed and the flows F3 and F4 flowing along the outer wall surface 30*c* of the downstream water conduit 30 are used as a main flow, making it possible to relatively strongly form the momentum of the cleaning water flowing into the rim water passage 20.

In this way, the cleaning water, as indicated at the arrows F3 and F4, becomes a linear flow toward the exit 30*b* from the inlet 30*a* of the downstream water conduit 30 along the linearly extending downstream water conduit 30. The cleaning water linearly flows over the center line C from the inlet 30*a* of the downstream water conduit 30, and the flow is uniformly adjusted while maintaining the water momentum. Therefore the cleaning water is suppressed from spreading out left and right from the exit 30*b* of the downstream water conduit 30, and linearly flows along the actual center line F.

As indicated at an arrow F7, the cleaning water flows along the inner wall surface 38 in the right side (one side) of the downstream water conduit 30. As indicated at an arrow F8, the cleaning water flowing along the inner wall surface 38 flows along the inner wall surface 38 to the downstream end portion 38*b* positioned in the left side (the other side) to the center line C of the toilet main body 2. Since the cleaning water flowing along the inner wall surface 38 flows to the left region over the center line C once, for example, in a case where the water momentum of the cleaning water supplied to the supply opening 6 of the toilet main body 2 from the storage tank 4 in the first half and the middle of a toilet cleaning operation is relatively strong, the cleaning water flowing out from the vicinity of the downstream end portion 38*b* is hard to flow toward the center rear region 20*b* of the rim water passage 20 in the vicinity of the center line C. Therefore the cleaning water flowing out from the vicinity of the downstream end portion 38*b* of the inner wall surface 38 is suppressed from flowing down to spread out toward a region of the vicinity of the center line C of the waste receiving surface 16, and, as indicated at an arrow F9, can form a linear main flow of the cleaning water toward the rim water passage 20 on an extension line of the inner wall surface 38 from the downstream water conduit 30.

Since the width of the downstream water conduit 30 is smaller than the width of the upstream water conduit 28, the flow velocity of the cleaning water flowing from the upstream water conduit 28 to the downstream water conduit 30 increases in the downstream water conduit 30. Therefore as indicated at the arrows F4 and F9, the cleaning water flowing out from the vicinity of the downstream end portion 38*b* of the inner wall surface 38 increases in flow velocity and water momentum. Accordingly the cleaning water is further suppressed from flowing to spread out in the region of the vicinity of the center line C, in the center rear region 20*b* and in the region of the vicinity of the center line C of the waste receiving surface 16, and it is possible to form the main flow of the cleaning water toward the rim water passage 20 from the downstream water conduit 30, and more excellently form the swirl flow of the cleaning water to swirl in the rim water passage 20.

As indicated at arrows F10 and F11 in FIG. 2, the cleaning water flowing out from the exit 30*b* of the downstream water conduit 30 flows around on the rim water passage 20. Since the amount of the cleaning water flowing down in the region of the vicinity of the center line C of the waste receiving surface 16 from the center rear region 20*b* is reduced, the flow amount per unit time toward the swirling direction of the cleaning water increases. A great part of the cleaning water forms the main flow of the swirl flow flowing on the rim water passage bottom surface 24 in the rim water passage 20.

The cleaning water forms this swirl flow, gradually flows down from the slit aperture 26 formed in the inside of the rim water passage bottom surface 24, and, as indicated at an arrow F12, uniformly cleans the entirety of the waste receiving surface 16 of the bowl 8. The cleaning water flowing down in the bowl 8 is discharged from the discharge trap conduit 14 together with wastes to end a series of cleaning operations of the toilet main body 2.

The flush toilet 1 according to the first embodiment of the present invention is provided with the bilaterally non-symmetric water conduit 10, but not limited thereto, may adopt a water conduit in a bilaterally reversed shape. In this case, the cleaning water flowing on the rim water passage forms the swirl flow in a clockwise direction. A flush toilet 101 according to a second embodiment and a flush toilet 201 according to a third embodiment as well may adopt the flow passage structure in a similar shape.

According to the flush toilet 1 by the first embodiment of the present invention as described above, the cleaning water turns from the upstream water conduit 28 extending to the right side of the toilet main body 2, flows into the downstream water conduit 30, and is introduced to the left side along the downstream water conduit 30. The cleaning water flowing along the inner wall surface 38 on the right side of the downstream water conduit 30 in the cleaning water introduced to the left side can flow along the inner wall surface 38 to the downstream end portion 38*b* positioned in the left side to the center line C of the toilet main body 2. Accordingly the cleaning water flowing out from the vicinity of the downstream end portion 38*b* of the inner wall surface 38 can be suppressed from flowing down in the region of the vicinity of the center line C and can form the main flow of the cleaning water toward the rim water passage 20 from the downstream water conduit 30. Therefore in the so-called open rim type flush toilet having the aperture formed on the entire circumference of the rim 18, it is possible to form the excellent swirl flow of the cleaning water to swirl in the rim water passage 20, and even in a case where the cleaning water amount to be used for toilet cleaning is set to be small, the bowl 8 can be sufficiently cleaned by the swirl flow.

According to the flush toilet 1 by the first embodiment of the present invention, the flow velocity of the cleaning water flowing into the downstream water conduit 30 from the upstream water conduit 28 increases in the downstream water conduit 30, and the cleaning water flowing out from the vicinity of the downstream end portion 38*b* of the inner wall surface 38 is further suppressed from flowing to spread out to the region in the vicinity of the center line C. In addition, the main flow of the cleaning water toward the rim water passage 20 from the downstream water conduit 30 can be formed, and more excellently it is possible to form the swirl flow of the cleaning water to swirl in the rim water passage 20.

Further, according to the flush toilet 1 by the first embodiment of the present invention, since the center line A1 of the upstream water conduit 28 extending to the right side of the toilet main body 2 extends to be biased in the right side to the center point c1 of the supply opening 6, the cleaning water flowing out from the supply opening 6 can relatively smoothly flow out to the biased upstream water conduit 28 from the right side to the center point c1 of the supply opening 6. Therefore as compared to a case where the center line A1 of the upstream water conduit 28 is not biased from the center point c1 of the supply opening 6, the cleaning water can relatively smoothly flow into the upstream water conduit 28 from a side of the upstream water conduit 28.

According to the flush toilet 1 by the first embodiment of the present invention, since the curvature radius r1 of the outer circumference wall 32*a* of the flow passage in the bending portion 32 is smaller than the curvature radius r2 of the inner circumference wall 32*b* of the flow passage in the bending portion 32, the flow along the outer circumference wall 32*a* of the flow passage in the bending portion 32 can be guided toward the flow along the inner circumference wall 32*b* of the flow passage in the bending portion 32, and the momentum of the cleaning water flowing into the rim water passage 20 along the outer wall surface 30*c* extending from the inner circumference wall 32*b*-side to the downstream water conduit 30 is strengthened, making it easier to form the flow to swirl in the rim water passage 20.

Next, an explanation will be made of a flush toilet according to a second embodiment of the present invention with reference to FIG. 4. In the flush toilet according to the second embodiment, components identical to those in the first embodiment as described above are designated by identical reference numerals, and the explanation is omitted.

A flush toilet 101 according to the second embodiment of the present invention has a toilet main body 102 formed of a pottery and the like.

A water conduit 110 is formed between the supply opening 6 and the rim water passage 20 on a rear upper portion of the toilet main body 102 to introduce the cleaning water supplied from a storage tank (unillustrated) from the supply opening 6 to the bowl 8.

In the second embodiment, only the configuration that a width of a downstream water conduit 130 of the water conduit 110 is made smaller from an inlet to an exit of the downstream water conduit 130 differs from a shape of the downstream water conduit 30 of the water conduit 10 in the flush toilet 1 of the first embodiment.

Next, an explanation will be in detail made of the downstream water conduit 130 of the water conduit 110.

Figure 4:
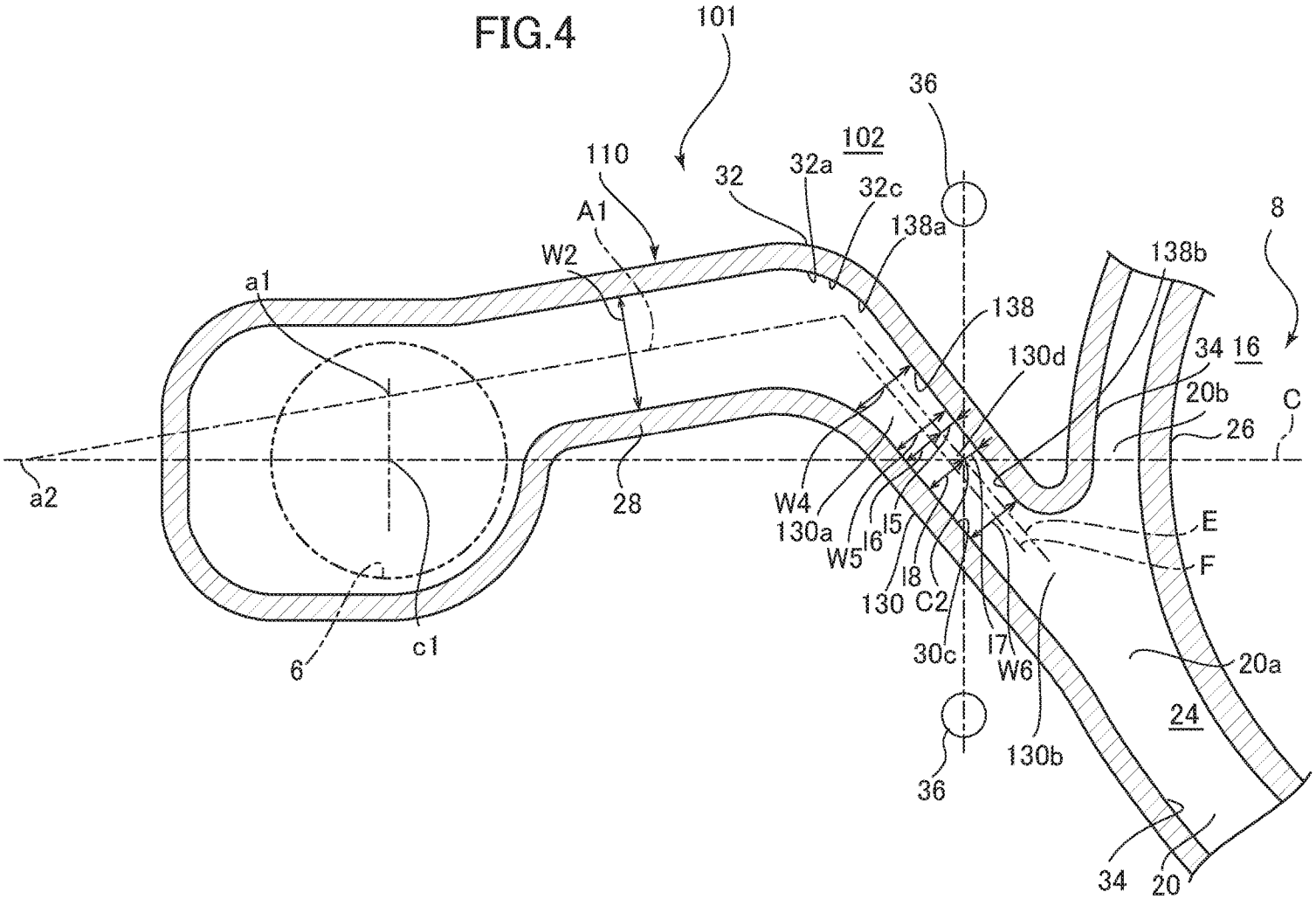
FIG. 4 is a schematic partial enlarged view illustrating a flow passage in a rear upper portion of a toilet main body in a flush toilet according to a second embodiment of the present invention by a horizontal cross-section plane.

As illustrated in FIG. 4, the downstream water conduit 130 forms a flow passage that extends to the left side from a downstream water conduit inlet 130*a* connected to the bending portion 32, and leads to a downstream water conduit exit 130*b* connected to the merging portion 20*a* of the rim water passage 20.

The downstream water conduit 130 has the inlet 130*a* arranged in the right region to the center line C, an intermediate portion 130*d* arranged in the central vicinity region of the vicinity of the center line C, and further, the exit 130*b* arranged in the left region in the left side to the center line C.

In the second embodiment, an inner wall surface 138 in the right side of the downstream water conduit 130 extends to the left side to the center line C from the right side to the center line C of the toilet main body 102.

The inner wall surface 138 forms an upstream end portion 138*a* that forms the inlet 130*a* and is connected to the downstream end portion 32*c* of the outer circumference wall 32*a* and a downstream end portion 138*b* that forms the exit 130*b* and is positioned in the left side to the center line C. Therefore the inner wall surface 138 extends over the center line C from the right side to the left side of the center line C.

The downstream end portion 138*b* of the inner wall surface 138 in the downstream water conduit 130 forms a convex portion projecting into a region of the left side to the center line C. The downstream end portion 138*b* of the inner wall surface 138 is connected to the rim water passage outer wall surface 34 extending from the rear side of the waste receiving surface 16 in the region of the left side to the center line C.

Since the downstream end portion 138*b* forms the convex portion projecting into the region of the left side to the center line C, the downstream end portion 138*b* sections the flow passage of the downstream water conduit 130 from the center rear region 20*b* of the rim water passage 20 on the center line C.

In the second embodiment as well, the inner wall surface 138 of the downstream water conduit 130 is formed to move the virtual inner wall surface 42 closer to the virtual center line E of the virtual downstream conduit 40, for example, by parallel movement, as similar to the first embodiment.

In the second embodiment of the present invention, which is different from the first embodiment, the width of the downstream water conduit 130 is smaller toward the intermediate portion 130*d* and the exit 130*b* from the inlet 130*a* of the downstream water conduit 130. Therefore there is a relation of width W4 of the inlet 130*a*>width W5 of the intermediate portion 130*d*>width W6 of the exit 130*b*. Here, since a distance from the virtual center line E to the outer wall surface 30*c* is constant, a distance from the virtual center line E to the inner wall surface 138 is smaller toward the intermediate portion 130*d* and the exit 130*b* from the inlet 130*a*.

The second embodiment also includes the structure that satisfies a relation of width W4 of the inlet 130*a*>width W6 of the exit 130*b* of the downstream water conduit 130. In addition, the second embodiment includes the structure that satisfies a relation of width W5 of the intermediate portion 130*d*>width W6 of the exit 130*b* of the downstream water conduit 130. For example, the width of the downstream water conduit 130 is made smaller in a substantially constant rate from the inlet 130*a* toward the exit 130*b*. When the width of the downstream water conduit 130 has the relation as described above, the width of the downstream water conduit 130 may non-linearly change without changing in a substantially constant rate from the inlet 130*a* toward the exit 130*b*.

The inner wall surface 138 is formed to be slightly inclined such that the downstream side is closer to the virtual center line E. The width of the downstream water conduit 130 in the second embodiment, for example, the width W4 of the inlet 130*a* is smaller than the width W2 of the upstream water conduit 28. The width W4 of the inlet 130*a* of the downstream water conduit 130 is smaller than, and approximately three-fourths of, the width W3 of the virtual downstream conduit 40 (refer to FIG. 3 because of omission in illustration of the virtual downstream conduit 40 in FIG. 4). Accordingly a distance 15 from the virtual center line E for connection between the point of the upstream water conduit 28 on the center line A1 and the intersection point C2 to the inner wall surface 138 is shorter than a distance 16 from the virtual center line E to the outer wall surface 30*c*. In addition, a distance 17 from the intersection point C2 to the inner wall surface 138 is shorter than a distance 18 from the intersection point C2 to the outer wall surface 30*c*.

As describe above, since the width of the downstream water conduit 130 is made smaller from the inlet 130*a* to the exit 130*b* and a cross-section area of the flow passage is also reduced, the flow velocity and water momentum of the cleaning water flowing into the downstream water conduit increase from the inlet 130*a* toward the exit 130*b* in the downstream water conduit. Therefore the cleaning water flowing out from the vicinity of the exit 130*b* increases in flow velocity and water momentum. Accordingly the cleaning water is further suppressed from flowing to spread out to the region in the vicinity of the center line C, for example, the center rear region 20*b* and the region in the vicinity of the center line C of the waste receiving surface 16 and the main flow of the cleaning water toward the rim water passage 20 from the downstream water conduit 130 can be formed, and more excellently it is possible to form the swirl flow of the cleaning water to swirl in the rim water passage 20.

Figure 5:
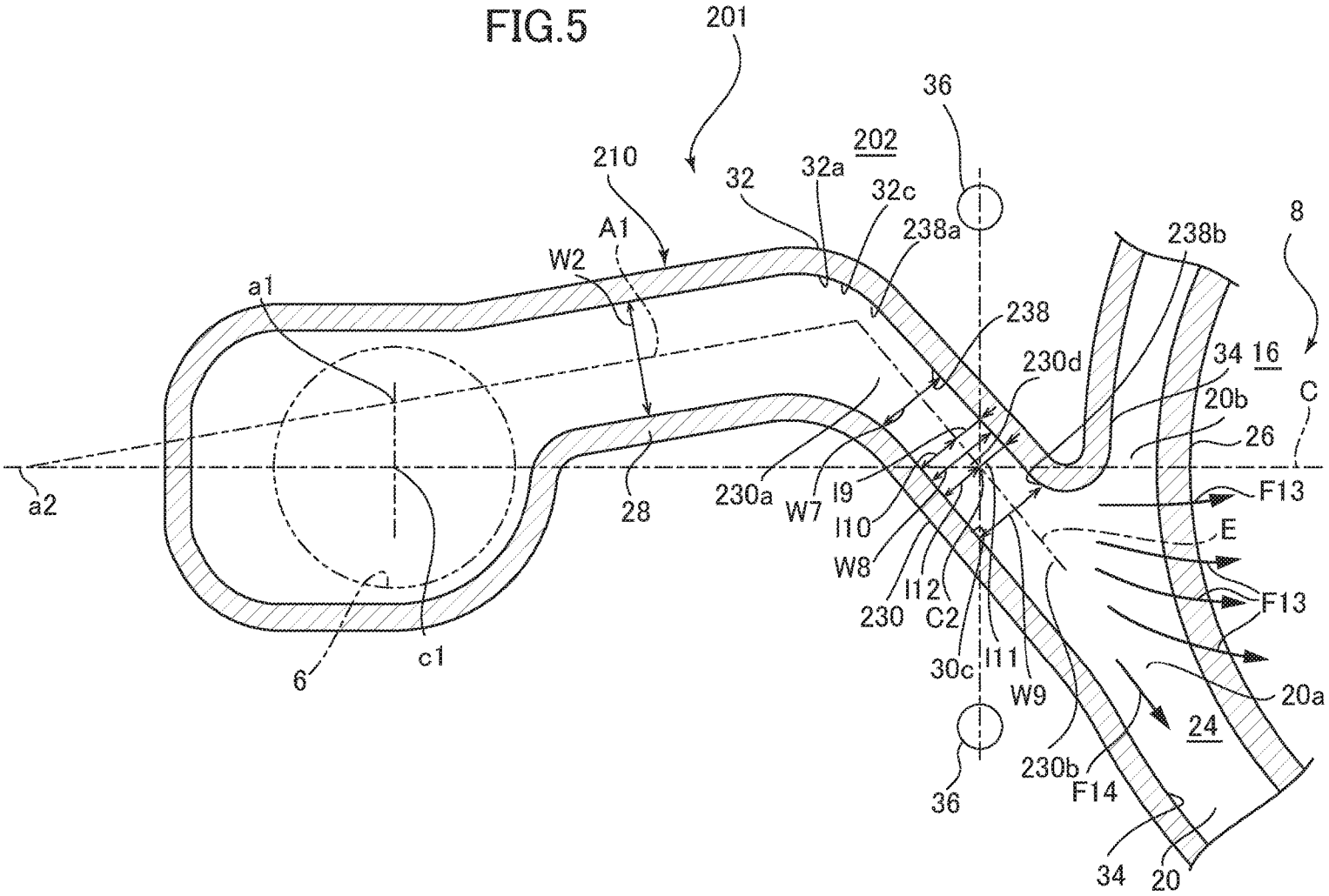
FIG. 5 is a schematic partial enlarged view illustrating a flow passage in a rear upper portion of a toilet main body in a flush toilet according to a third embodiment of the present invention by a horizontal cross-section plane.

Next, an explanation will be made of a flush toilet according to a third embodiment of the present invention with reference to FIG. 5. In the third embodiment, components identical to those in the first embodiment as described above are designated by identical reference numerals, and the explanation is omitted.

A flush toilet 201 according to the third embodiment of the present invention has a toilet main body 202 formed of a pottery and the like.

In the toilet main body 202, a water conduit 210 is formed between the supply opening 6 and the rim water passage 20 to introduce the cleaning water supplied from the storage tank (unillustrated) from the supply opening 6 to the bowl 8.

In the third embodiment, only the configuration that a shape of a downstream water conduit 230 of the water conduit 210 is formed such that a width of the downstream water conduit 230 is larger from an inlet to an exit of the downstream water conduit 230 differs from the shape of the downstream water conduit 30 of the water conduit 10 of the first embodiment.

Next, an explanation will be in detail made of the downstream water conduit 230. As illustrated in FIG. 5, the downstream water conduit 230 forms a flow passage that extends to the left side from an inlet 230*a* connected to the bending portion 32 and leads to an exit 230*b* connected to the merging portion 20*a* of the rim water passage 20.

The downstream water conduit 230 has the inlet 230*a* arranged in the right region in the right side to the center line C, an intermediate portion 230*d* arranged in the central vicinity region of the vicinity of the center line C, and further, the exit 230*b* arranged in the left region in the left side to the center line C.

In the third embodiment, an inner wall surface 238 in the right side of the downstream water conduit 230 extends to the left region to the center line C from the right side to the center line C of the toilet main body 202.

The inner wall surface 238 forms an upstream end portion 238*a* that forms the inlet 230*a* of the downstream water conduit 230 and is connected to the downstream end portion 32*c* of the outer circumference wall 32*a*, and a downstream end portion 238*b* that forms a downstream water conduit exit 230*b* and is positioned in the left side to the center line C. Therefore the inner wall surface 238 extends over the center line C from the right side to the left side of the center line C.

The downstream end portion 238*b* of the inner wall surface 238 in the downstream water conduit 230 forms a convex portion projecting into a region of the left side to the center line C. The downstream end portion 238*b* of the inner wall surface 238 is connected to the rim water passage outer wall surface 34 extending from the rear side of the waste receiving surface 16 in the region of the left side to the center line C.

Since the downstream end portion 238*b* forms the convex portion projecting in the left side to the center line C, the downstream end portion 238*b* sections the flow passage of the downstream water conduit 230 from the center rear region 20*b* of the rim water passage 20 on the center line C.

In the third embodiment as well, the inner wall surface 238 of the downstream water conduit 230 is formed to move the virtual inner wall surface 42 (refer to FIG. 3) closer to the virtual center line E of the virtual downstream conduit 40 in the virtual form (refer to FIG. 3) as similar to the first embodiment, for example, by parallel movement.

In the third embodiment of the present invention, which is different from the first embodiment, the width of the downstream water conduit 230 is made larger toward the intermediate portion 230*d* and the exit 230*b* from the inlet 230*a*. Therefore there is a relation of width W7 of the inlet 230*a*<width W8 of the intermediate portion 230*d*<width W9 of the exit 230*b* of the downstream water conduit 230. Here, since a distance from the virtual center line E to the outer wall surface 30*c* is constant, a distance from the virtual center line E to the inner wall surface 238 is made larger toward the intermediate portion 230*d* and the exit 230*b* from the inlet 230*a*.

The third embodiment also includes the structure that satisfies a relation of width W7 of the inlet 230*a*<width W9 of the exit 230*b* of the downstream water conduit 230. In addition, the third embodiment includes the structure that satisfies a relation of width W8 of the intermediate portion 230*d*<width W9 of the exit 230*b*. For example, the width of the downstream water conduit 230 is made small in a substantially constant rate from the inlet 230*a* toward the exit 230*b*. When the width of the downstream water conduit 230 has the relation as described above, the width of the downstream water conduit 230 may non-linearly change without changing in a substantially constant rate from the downstream water conduit inlet 230*a* toward the downstream water conduit exit 230*b*.

The inner wall surface 238 is formed to be slightly inclined such that the downstream side is separated from the virtual center line E. The width W7 of the downstream water conduit 230 in the present embodiment is smaller than the width W2 of the upstream water conduit 28. For example, even the width W9 of the exit 230*b* of the downstream water conduit 230 is smaller than the width W2 of the upstream water conduit 28. The width W7 of the inlet 230*a* is smaller than, and approximately three-fourths of, the width W3 of the virtual downstream conduit 40 (refer to FIG. 3 because of omission in illustration of the virtual downstream conduit 40 in FIG. 5). Accordingly a distance 19 from the virtual center line E for connection between the point of the upstream water conduit 28 on the center line A1 and the intersection point C2 to the inner wall surface 238 is shorter than a distance 110 from the virtual center line E to the outer wall surface 30*c*. In addition, a distance 111 from the intersection point C2 to the inner wall surface 238 is shorter than a distance 112 from the intersection point C2 to the outer wall surface 30*c*.

As describe above, since the width of the downstream water conduit 230 is made wider toward the exit 230*b* from the inlet 230*a*, in a case where the water momentum of the cleaning water to be supplied to the toilet main body 202 from the storage tank 4 is made weaker in the latter half of a toilet cleaning operation (or timing immediately before end of the toilet cleaning operation), as indicated at an arrow F13 the cleaning water flowing into the downstream water conduit 230 can form the flow to widen from the inlet 230*a* toward the exit 230*b* by a relatively gradual momentum and a relatively slow flow velocity of the cleaning water. Accordingly the cleaning water flowing out from the exit 230*b* of the downstream water conduit 230 can form the flow spreading out in a fan shape corresponding to the widening of the width of the downstream water conduit 230, and flows to spread out in a wide range of the bowl along with the flow with reduced flow velocity and water momentum swirling on the rim water passage 20 and returning back to the center rear region 20*b*, making it possible to clean a wide range of the bowl more uniformly.

On the other hand, in a case where the water momentum of the cleaning water supplied to the supply opening 6 of the toilet main body 202 from the storage tank 4 in the first half and in the middle of the toilet cleaning operation is relatively strong, as indicated at an arrow F14 the cleaning water flowing in the downstream water conduit 230 can form a flow having directivity linearly oriented toward the rim water passage 20 from the downstream water conduit 230 as described above along the flow passage of the downstream water conduit 230 linearly extending in a predetermined length, the outer wall surface 30*c* and the like.

According to the flush toilet 201 of the third embodiment in the present invention as described above, since the width of the downstream water conduit 230 is made larger toward the exit 230*b* from the inlet 230*a*, in a case where the water momentum of the cleaning water to be supplied to the supply opening 6 of the toilet main body 202 from the storage tank 4 is made weaker in the latter half of the toilet cleaning operation, the cleaning water flowing out from the exit 230*b* can form the flow spreading out in a fan shape corresponding to the widening of the width of the downstream water conduit 230 to clean a wide range of the bowl 8 more uniformly.

Figure 6:
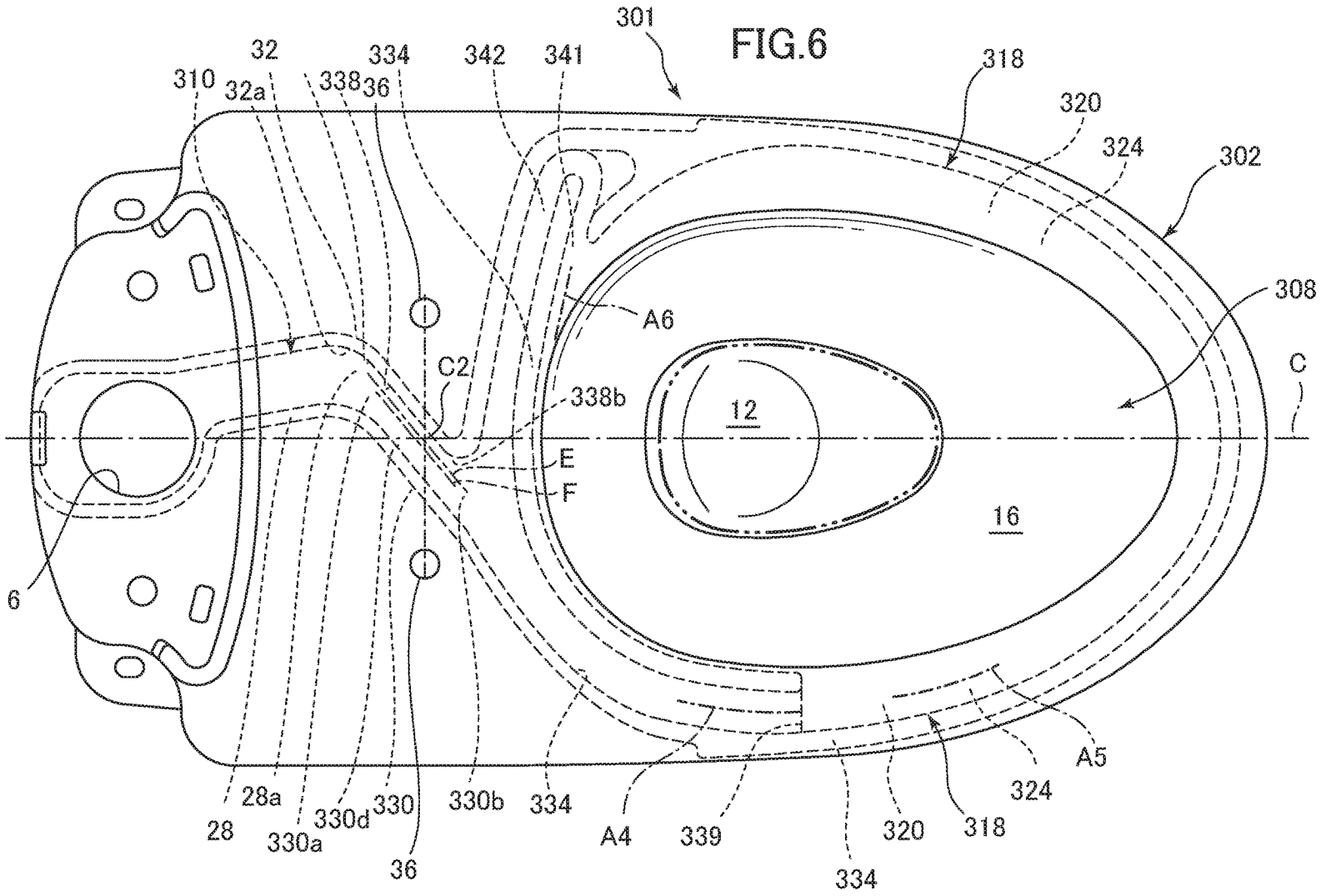
FIG. 6 is a schematic partial enlarged view illustrating a flow passage in a rear upper portion of a toilet main body in a flush toilet according to a fourth embodiment of the present invention.

Next, an explanation will be made of a fourth embodiment of the present invention with reference to FIG. 6. In the fourth embodiment, components identical to those in the first embodiment as described above are designated by identical reference numerals, and the explanation is omitted.

A flush toilet 301 according to the fourth embodiment of the present invention has a toilet main body 302 formed of a pottery and the like.

An upper edge portion of a bowl 308 of the toilet main body 302 is provided with a rim 318 overhung inside, a first spout opening 339 and a second spout opening 341 formed on a rim water passage 320, and the cleaning water to be supplied from a water conduit 310 formed in the inside of the rear side of the toilet main body 302 is spouted from the first spout opening 339 and the second spout opening 341.

In the fourth embodiment, a rim, which is different from the open rim type form according to the first to third embodiments, is a rim 318 of a so-called non-brim type. The flush toilet 301 having the rim 318 of the non-brim type spouts the cleaning water on the rim 318 from the first spout opening 339 and the second spout opening 341 to form a swirl flow swirling on the waste receiving surface 16. The flush toilet 301 according to the fourth embodiment may have only the first spout opening 339, and the first spout opening 339 arranged on an extension of the flow passage of the water conduit 310 may be arranged in any location of an entire circumference of the rim.

The cleaning water spouted from the first spout opening 339 flows on the rim water passage bottom surface (shelf surface) 324 in the rim water passage 320 to swirl on an upper portion of the bowl 308, and flows down on the waste receiving surface 16 from the rim water passage bottom surface 324 while swirling to clean the bowl 308. The cleaning water spouted from the second spout opening 341 flows on the rim water passage bottom surface 324 in the rim water passage 320 to swirl on an upper portion of the bowl 308, and flows down on the waste receiving surface 16 from the rim water passage bottom surface 324 while swirling to clean the bowl 308.

In the present embodiment, the rim 318 overhangs inside, but may have a longitudinal wall-shaped form extending substantially vertically.

The rim 318 is formed in the inside of a substantially entire circumference or a large part of the upper edge portion of the bowl 308, making it possible to introduce the cleaning water. The rim 318 is positioned on an upper side of the waste receiving surface 16, and an upper portion of a rim water passage outer wall surface 334 as the inner wall surface is formed to project toward the inside. The rim 318 is formed such that the rim water passage bottom surface 324 of the rim 318 extends horizontally toward the inside. Therefore the rim 318 forms the rim water passage 320 on the rim water passage bottom surface 324. The inside and lower side of the rim water passage 320 formed along the circumferential direction of the rim 318 open over the entire circumference, and the waste receiving surface 16 of the bowl 308 is formed.

The rim water passage bottom surface 324 forms the shelf-shaped rim water passage bottom surface 324 formed over a substantially entire circumference of the bowl 308. The rim water passage bottom surface 324 forms a flat surface annularly formed on the upper portion of the bowl 308, and the flat surface is substantially horizontally formed from an outer direction to an inner direction of the bowl 308. With this configuration, the cleaning water supplied from the water conduit 310 can form the flow going around on the upper portion of the bowl 308 while flowing on the rim water passage bottom surface 324 in the rim water passage 320.

The water conduit 310 is provided with the supply opening 6, the upstream water conduit 28 that is formed between the first spout opening 339 and the second spout opening 341 and extends from the vicinity of the supply opening 6 to the right side of the toilet main body 302, and a downstream water conduit 330 extending to the left side from the upstream water conduit 28.

The downstream water conduit 330 in the fourth embodiment of the present invention has the structure and function as similar to those of the downstream water conduit 30 in the first embodiment of the present invention. However, a point where the exit 330*b* of the downstream water conduit 330 is communicated with the first spout opening 339 and a downstream branched water passage 342 branched from the exit 330*b* extends to the second spout opening 341 differs from the downstream water conduit 30 in the first embodiment of the present invention.

Next, an explanation will be in detail made of the downstream water conduit 330. As illustrated in FIG. 6, the downstream water conduit 330 forms a flow passage that extends to the left side from an inlet 330*a* connected to the bending portion 32 and leads to an exit 330*b* connected to the rim water passage 320.

The downstream water conduit 330 has the inlet 330*a* arranged in the right region to the center line C, an intermediate portion 330*d* arranged in the central vicinity region of the vicinity of the center line C, and further, the exit 330*b* arranged in the left region to the center line C.

In the fourth embodiment, an inner wall surface 338 of the downstream water conduit 330 in the right side extends to the left region to the center line C from the right side to the center line C of the toilet main body 302.

The inner wall surface 338 forms an upstream end portion 338*a* that forms the inlet 330*a* of the downstream water conduit 330 and is connected to the outer circumference wall 32*a*, and a downstream end portion 338*b* that forms the exit 330*b* and is positioned in the left side to the center line C. Therefore the inner wall surface 338 extends over the center line C from the right side to the left side of the center line C.

In the fourth embodiment as well, the inner wall surface 338 of the downstream water conduit 330 of the present embodiment is formed to move the virtual inner wall surface 42 closer to the virtual center line E of the virtual downstream conduit 40 in the virtual form as similar to the first embodiment, for example, by parallel movement.

Next, an explanation will be made of a function (operation) of the flush toilet according to the fourth embodiment of the present invention with reference to FIG. 6.

In the fourth embodiment of the present invention, the cleaning water flowing into the water conduit 310 flows toward the right side of the toilet main body 302 in the upstream water conduit 28. That is, the cleaning water flows toward the right side to be away from the center line C. When the cleaning water reaches the exit 28*a* of the upstream water conduit 28, the cleaning water turns in the bending portion 32.

Subsequently the cleaning water flows into the downstream water conduit 330 extending toward the left front side at the opposite side. The cleaning water forms a linear flow from the inlet 330*a* toward the first spout opening 339 along the downstream water conduit 330 linearly extending.

Since the structure of the downstream water conduit 330 in the fourth embodiment is substantially similar to the structure of the downstream water conduit 30 in the first embodiment, the flow of the cleaning water in the downstream water conduit 330 in the fourth embodiment is substantially similar to the flow of the cleaning water in the downstream water conduit 30 in the first embodiment.

Also in the fourth embodiment, the cleaning water introduced to the successive inner wall surface 338 from the outer circumference wall 32*a* flows along the inner wall surface 338 in the right side of the downstream water conduit 330. The cleaning water flowing along the inner wall surface 338 can flow along the inner wall surface 338 to the downstream end portion 338*b* positioned in the left side to the center line C of the toilet main body 302. The cleaning water flowing out from the vicinity of the downstream end portion 338*b* of the inner wall surface 338 can linearly form a main flow of the cleaning water toward the rim water passage 320 on the extension line of the inner wall surface 338 from the downstream water conduit 330.

The cleaning water passing the downstream water conduit 330 linearly flows over the center line C, and the direction of the flow is adjusted relatively uniformly while maintaining the water momentum. Accordingly the cleaning water can be suppressed from spreading out in the left and right from the first spout opening 339 to linearly flow along a flow line A4 to a flow line A5.

On the other hand, a part of the cleaning water flows to be branched from the downstream water conduit 330 to a downstream branched water passage 342, and after linearly flowing along the downstream branched water passage 342, is spouted from the second spout opening 341 on the rim water passage bottom surface 324.

The cleaning water flowing out from the first spout opening 339 flows in the rim water passage 320 along the flow line A5 of the cleaning water to go around on the rim water passage 320. A flow amount per unit time of the cleaning water toward the swirling direction increases. The flow velocity and water momentum of the cleaning water at the time of flowing out toward the rim water passage 320 from the first spout opening 339 are strengthened, and even in a case of adopting the rim other than the open rim (for example, non-brim type rim), the flow to swirl in the rim water passage 320 tends to be easily formed.

The cleaning water from the second spout opening 341 flows in the rim water passage 320 along the flow line A6 of the cleaning water to go around on the rim water passage 320. A flow amount per unit time of the cleaning water toward the swirling direction increases. The flow velocity and water momentum of the cleaning water at the time of flowing into toward the rim water passage 320 from the second spout opening 341 are strengthened, and even in a case of adopting the rim other than the open rim (for example, non-brim type rim), the flow to swirl in the rim water passage 320 tends to be easily formed.

In this way, the cleaning water flows on the rim water passage bottom surface 324 in the rim water passage 320 to form the swirl flow in a counterclockwise direction. The cleaning water forms this swirl flow, and gradually flows down on the waste receiving surface 16 of the bowl 308 in the inside of the rim water passage bottom surface 324 to uniformly clean the entirety of the bowl 308. The cleaning water flowing down in the bowl 308 is discharged from the discharge trap conduit 14 together with wastes to end a series of cleaning operations of the toilet main body 302.

According to the flush toilet 301 by the fourth embodiment of the present invention as described above, the cleaning water turns from the upstream water conduit 28 extending to the right side of the toilet main body 302, flows into the downstream water conduit 330, and is introduced to the left side along the downstream water conduit 330. The cleaning water flowing along the inner wall surface 338 on the right side of the downstream water conduit 330 in the cleaning water introduced to the left side from the right side can flow along the inner wall surface 338 to the downstream end portion 338*b* positioned in the left side to the center line C of the toilet main body 302. Accordingly the cleaning water flowing out from the vicinity of the downstream end portion 338*b* of the inner wall surface 338 can form the main flow of the cleaning water toward the first spout opening 339 and the second spout opening 341 from the downstream water conduit 330. Therefore in the so-called non-brim type flush toilet, the cleaning water spouted from the first spout opening 339 and the second spout opening 341 can form the excellent swirl flow of the cleaning water to swirl on the waste receiving surface 16, and even in a case where the cleaning water amount to be used for toilet cleaning is set to be small, the bowl 308 can be sufficiently cleaned by the swirl flow.

Next, an explanation will be made of a flush toilet according to a fifth embodiment of the present invention with reference to FIG. 7 and FIG. 8. In the flush toilet according to the fifth embodiment, components identical to those in the first embodiment as described above are designated by identical reference numerals, and the explanation is omitted.

Figure 7:
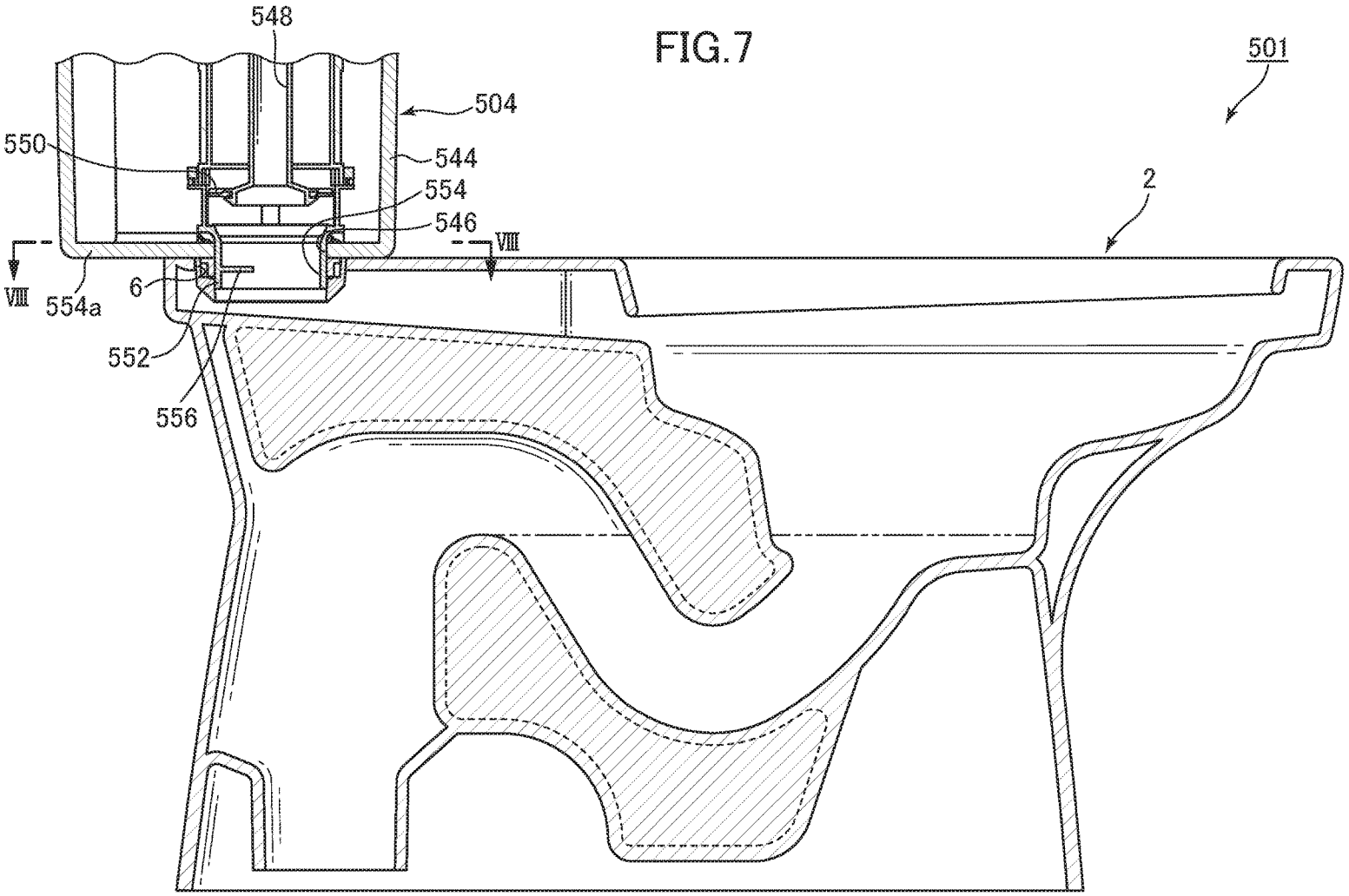
FIG. 7 is a side cross section illustrating a flush toilet according to a fifth embodiment of the present invention.
Figure 8:
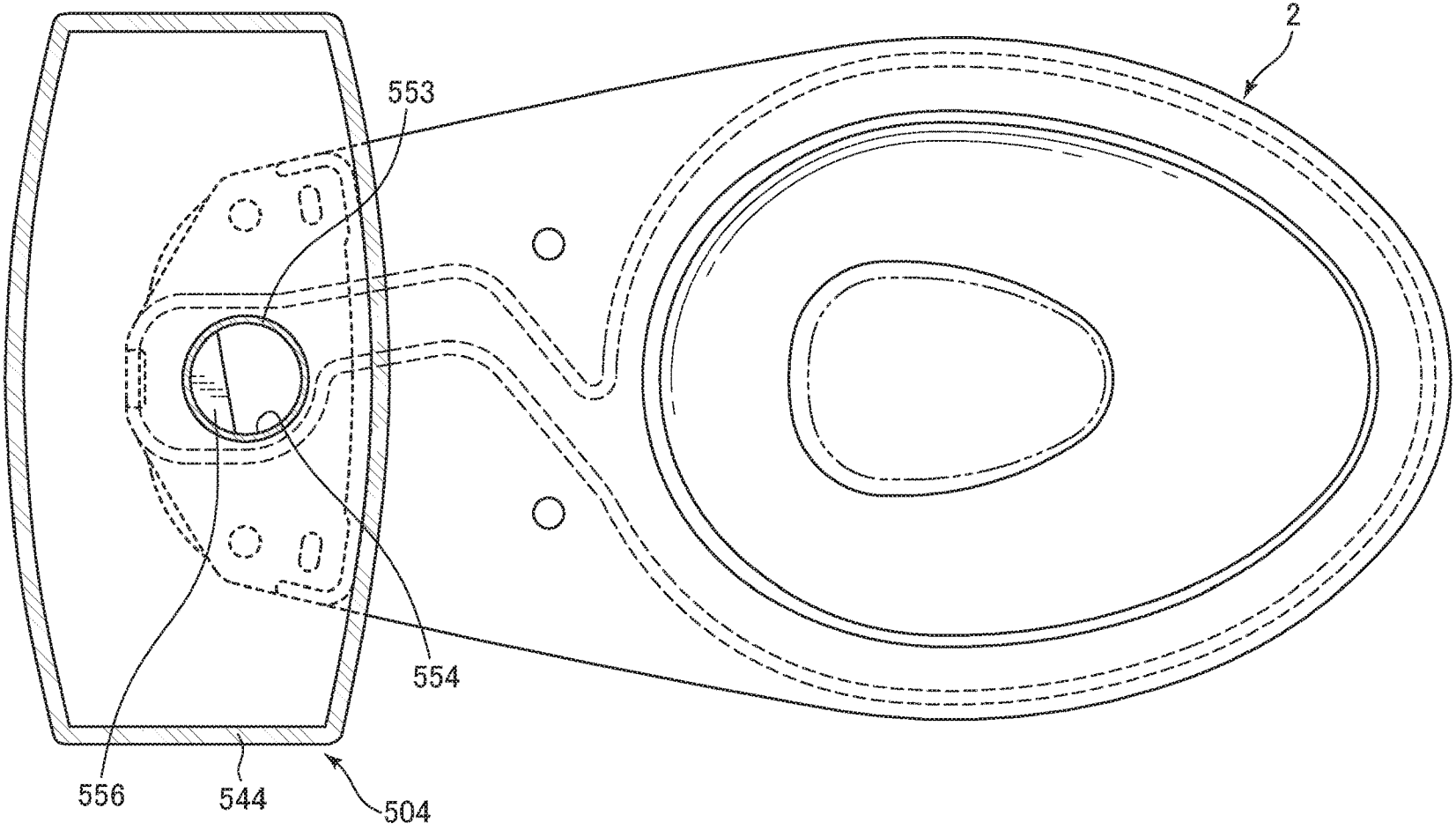
FIG. 8 is a plan cross section as viewed along line VIII-VIII in FIG. 8.

As illustrated in FIG. 7 and FIG. 8, a flush toilet 501 according to the fifth embodiment of the present invention has a storage tank 504 for storing cleaning water. The storage tank 504 includes a tank main body 544 for storing cleaning water, a discharge opening 546 provided on a bottom portion 544*a* of the tank main body 544, a discharge valve device 548 that opens/closes the discharge opening 546, and a cylindrical cleaning water guiding member 552 that is attached on the discharge opening 546 and guides the cleaning water to the supply opening 6 of the toilet main body 2.

The discharge valve device 548 is a so-called direct-driven type discharge valve device, and is provided with a discharge valve body 550 that is formed to be movable in the upper-lower direction in the storage tank 504. In the discharge valve device 548, the discharge opening 546 opens/closes by an upper/lower movement of the discharge valve body 550 caused by an operation of an operating lever (unillustrated) provided in the storage tank 504.

The cleaning water guiding member 552 forms a guiding flow passage 554 that is a flow passage that guides the cleaning water to the supply opening 6 of the toilet main body 2 from the discharge opening 546 of the storage tank 504.

The cleaning water guiding member 552 is provided with a narrowed portion 556 that projects to the guiding flow passage 554 from a part of the inner wall.

The narrowed portion 556 is a semicircular plate member projecting in a direction of the upstream water conduit 28 of the water conduit 10 as described above. The guiding flow passage 554 in a location where the narrowed portion 556 is provided is narrowed by an area where the narrowed portion 556 exists toward the extension direction of the upstream water conduit 28.

The cleaning water supplied to the supply opening 6 tends to easily flow toward the upstream water conduit 28 by the narrowed portion 556 of the cleaning water guiding member 552.

Figure 9:
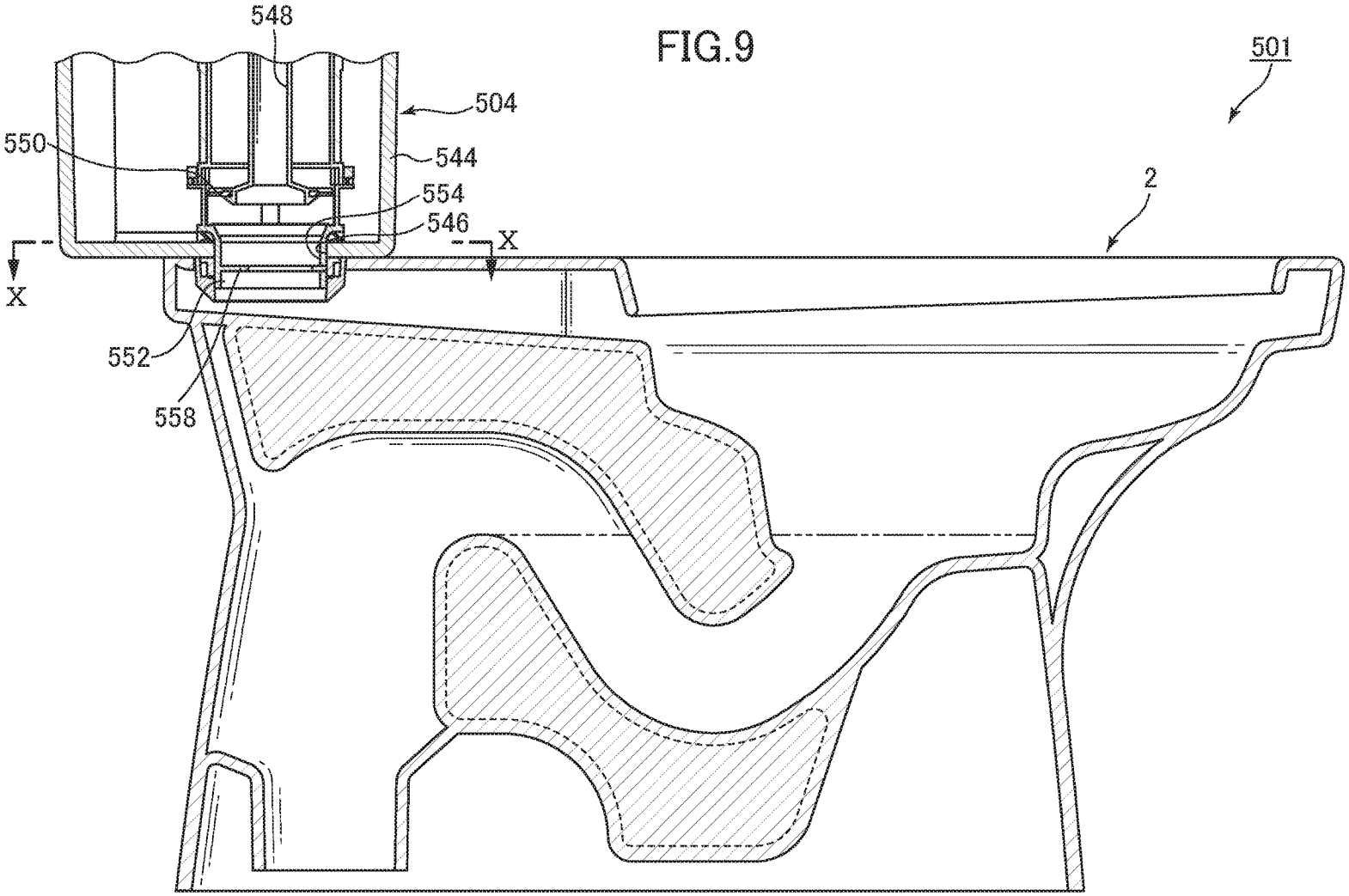
FIG. 9 is a side cross section illustrating a flush toilet provided with a modification of a cleaning water guiding member according to the fifth embodiment of the present invention.
Figure 10:
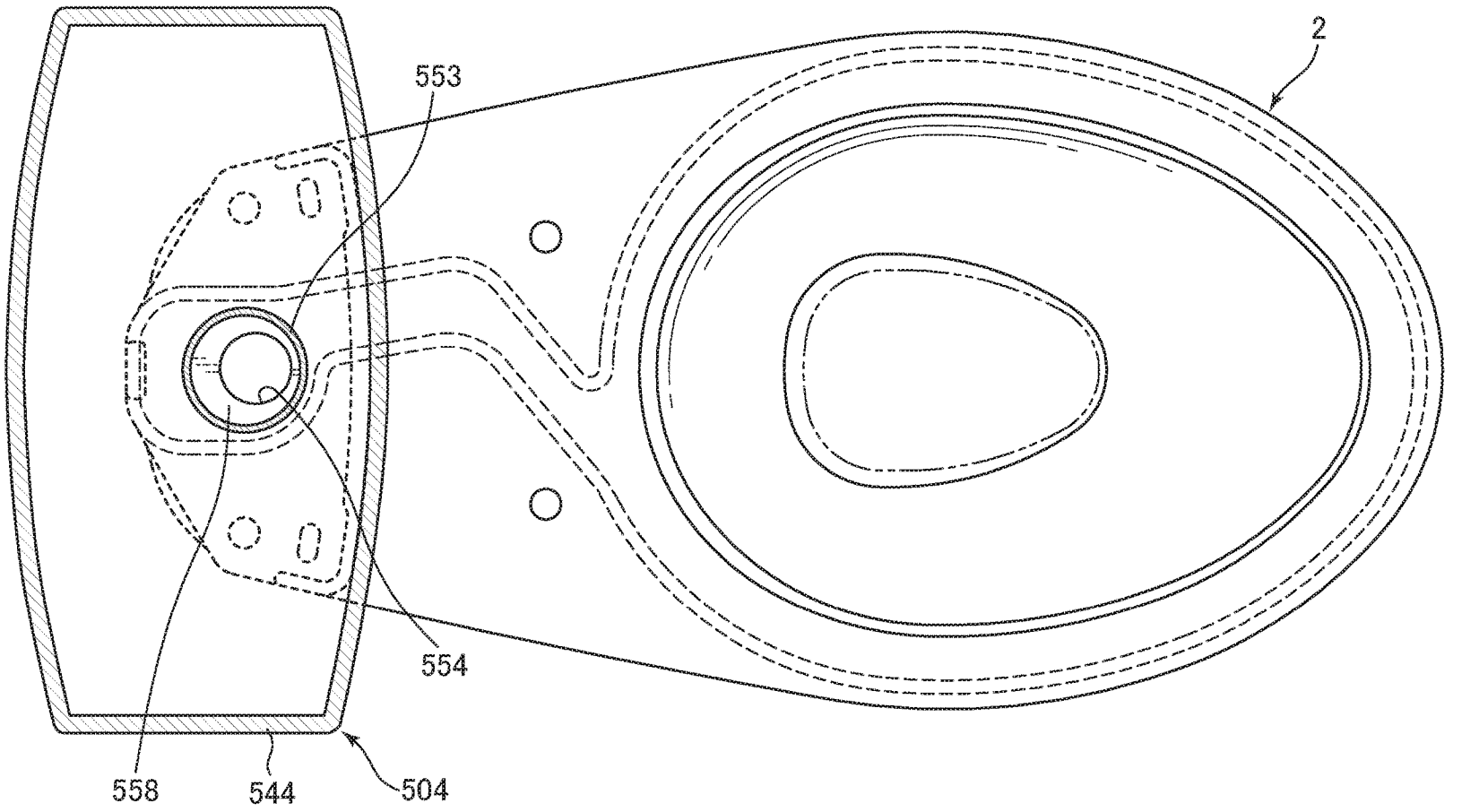
FIG. 10 is a plan cross section as viewed along line X-X in FIG. 9.
Figure 11:
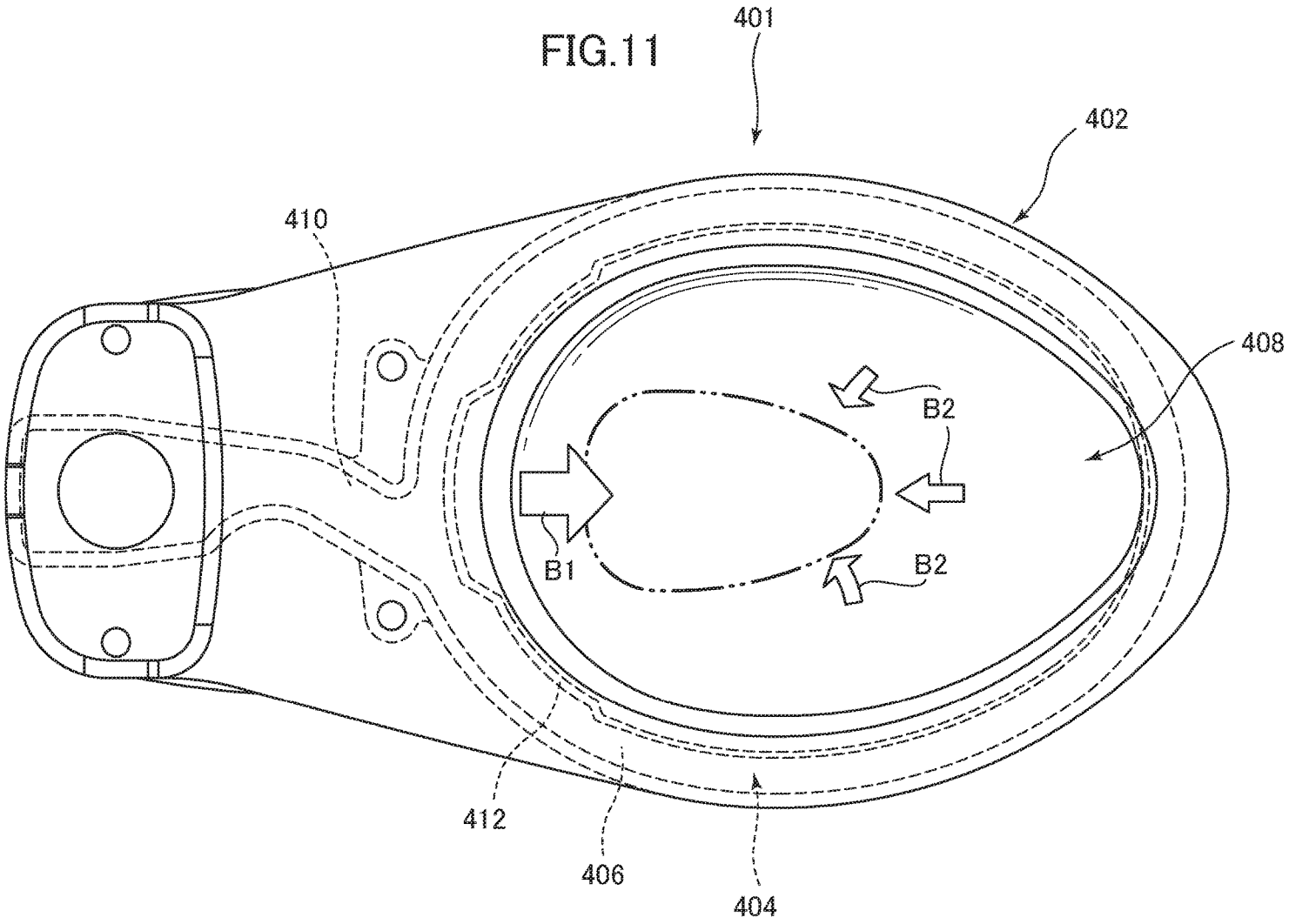
FIG. 11 is a plan view illustrating a toilet main body of a conventional flush toilet.

In the flush toilet 501 of the fifth embodiment, the narrowed portion 556 of the cleaning water guiding member 552 is formed in the semicircular shape, but may be formed as a modification illustrated in FIG. 9 and FIG. 10. In this modification, a narrowed portion 558 is provided to project in the inside of the guiding flow passage 554 from an entire circumference of the inner wall of the cleaning water guiding member 552, and is formed in such a shape as to bore a small circular hole from a large circular form. In the narrowed portion 558 as well, the guiding flow passage 554 in a location where the narrowed portion 558 is provided is narrowed by an area where the narrowed portion 558 exists toward the extension direction of the upstream water conduit 28. The cleaning water supplied to the supply opening 6 tends to easily flow toward the upstream water conduit 28 by the narrowed portion 558 of the cleaning water guiding member 552.

Next, an explanation will be made of a function (operation) of the flush toilet 501 according to the fifth embodiment of the present invention with reference to FIG. 7 to FIG. 10.

In the fifth embodiment of the present invention, the discharge valve body 550 of the storage tank 504 operates by an operation of an operating lever (unillustrated) provided in the storage tank 504 to open the discharge opening 546, and the cleaning water flows into the cleaning water guiding member 552. The cleaning water having flown in flows along the guiding flow passage 554 of the cleaning water guiding member 552, and flows out into the supply opening 6 of the toilet main body 2.

At this time, since the guiding flow passage 554 of the cleaning water guiding member 552 is narrowed such that the cleaning water flows in an extension direction of the upstream water conduit 28 by the narrowed portions 556, 558, when the cleaning water flows in the guiding flow passage 554 along the narrowed portions 556, 558, the cleaning water flowing in the guiding flow passage 554 is guided in the extension direction of the upstream water conduit 28, and tends to easily flow in the extension direction of the upstream water conduit 28.

Therefore it is possible to produce the flow of the cleaning water toward the extension direction of the upstream water conduit 28, and more excellently form the swirl flow of the cleaning water to swirl in the rim water passage 20.

What is claimed is:

1. A flush toilet that cleans a bowl by cleaning water, comprising:

a toilet main body; and a water supply device that supplies the cleaning water to a supply opening of the toilet main body;

the toilet main body including:

a bowl having a waste receiving surface having a bowl shape, a rim provided on an upper side of the waste receiving surface, a rim water passage formed on an entire circumference of the rim to introduce the cleaning water, and an aperture formed on the entire circumference of the rim to supply the cleaning water on the waste receiving surface from the rim water passage;

a discharge passage an inlet of which is connected to a lower side of the bowl to discharge wastes; and a water conduit formed between the supply opening and the rim water passage to introduce the cleaning water to the rim water passage, wherein the water conduit includes an upstream water conduit extending from the supply opening to one side from a center line of the toilet main body, the center line being positioned from a front end to a rear end of the toilet main body and at a center in a left-right direction of the toilet main body, and a downstream water conduit extending from the upstream water conduit to the other side from the center line of the toilet main body, the upstream water conduit is formed such that an entire downstream end of an inner wall surface of the upstream water conduit is positioned in the one side from the center line of the toilet main body, and the downstream water conduit is formed such that an entire downstream end of an inner wall surface of the downstream water conduit is positioned in the other side from the center line of the toilet main body.

2. The flush toilet according to claim 1, wherein a width of the downstream water conduit is smaller than a width of the upstream water conduit.

3. The flush toilet according to claim 1, wherein a width of the downstream water conduit is made smaller toward an exit of the downstream water conduit from an inlet of the downstream water conduit.

4. The flush toilet according to claim 1, wherein a width of the downstream water conduit is made larger toward an exit of the downstream water conduit from an inlet of the downstream water conduit.

5. The flush toilet according to claim 1, wherein a center line of the upstream water conduit extends to be biased to one side in the left-right direction from a center of the supply opening.

6. The flush toilet according to claim 1, wherein the water conduit further includes a bending portion formed between an exit of the upstream water conduit and an inlet of the downstream water conduit, wherein the bending portion is formed such that a curvature radius of an outer circumference wall of a flow passage in the bending portion is smaller than a curvature radius of an inner circumference wall of the flow passage.

7. The flush toilet according to claim 1, wherein the water supply device is a storage tank that stores cleaning water, wherein a bottom portion of the storage tank is provided with a discharge opening that supplies the cleaning water to the supply opening of the toilet main body, and the discharge opening of the storage tank is provided with a guiding device that guides the cleaning water to be supplied to the supply opening of the toilet main body to an extension direction of the upstream water conduit.

8. The flush toilet according to claim 7, wherein the guiding device is a cylindrical guiding member for connection between the discharge opening and the supply opening, wherein the guiding member is provided with a narrowed portion projecting inside from a part of or an entire circumference of an inner wall of the guiding member such that the cleaning water supplied to the supply opening flows to the extension direction of the upstream water conduit.

9. A flush toilet that cleans a bowl by cleaning water, comprising:

a toilet main body; and a water supply device that supplies the cleaning water to a supply opening of a toilet main body;

the toilet main body including a bowl having a waste receiving surface having a bowl shape, a rim provided on an upper edge portion of the bowl, a rim water passage formed on an inner circumference of the rim to introduce the cleaning water, and a spout portion opening on the rim water passage and spouting the cleaning water to the rim water passage;

a discharge passage connected to a lower side of the bowl to discharge wastes; and a water conduit formed between the supply opening and the spout portion to introduce the cleaning water to the spout portion, wherein the water conduit includes an upstream water conduit extending from the supply opening to one side from a center line of the toilet main body, the center line being positioned from a front end to a rear end of the toilet main body and at a center in a left-right direction of the toilet main body, and a downstream water conduit extending from the upstream water conduit to the other side from the center line of the toilet main body, the upstream water conduit is formed such that an entire downstream end of an inner wall surface of the upstream water conduit is positioned in the one side from the center line of the toilet main body, and the downstream water conduit is formed such that an entire downstream end of an inner wall surface of the downstream water conduit is positioned in the other side from the center line of the toilet main body.

* * * * *